US006963328B2

(12) United States Patent
Kang et al.

(10) Patent No.: US 6,963,328 B2
(45) Date of Patent: Nov. 8, 2005

(54) APPARATUS AND METHOD DATA-DRIVING FOR LIQUID CRYSTAL DISPLAY DEVICE

(75) Inventors: Sin Ho Kang, Kyonggi-do (KR); Seung Kuk Ahn, Kyongsangbuk-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 328 days.

(21) Appl. No.: 10/422,813

(22) Filed: Apr. 25, 2003

(65) Prior Publication Data

US 2004/0104872 A1 Jun. 3, 2004

(30) Foreign Application Priority Data

Dec. 3, 2002 (KR) ..... 10-2002-0076366

(51) Int. Cl.[7] ..... G09G 3/36
(52) U.S. Cl. ..... 345/100; 345/98; 345/204
(58) Field of Search ..... 345/87, 89, 98, 345/100

(56) References Cited

U.S. PATENT DOCUMENTS 5,739,805 A * 4/1998 Dingwall ..... 345/100
6,097,362 A * 8/2000 Kim ..... 345/87
6,169,529 B1 * 1/2001 Hansen et al. ..... 345/74.1
6,333,730 B1 * 12/2001 Lee ..... 345/100
6,335,721 B1 * 1/2002 Jeong ..... 345/100
6,876,365 B1 * 4/2005 Tsutsui et al. ..... 345/536
6,879,310 B2 * 4/2005 Nose ..... 345/88
2001/0050665 A1 12/2001 Yeo et al.

* cited by examiner

*Primary Examiner*—Regina Liang
*Assistant Examiner*—Duc Q Dinh
(74) *Attorney, Agent, or Firm*—McKenna Long & Aldridge LLP

(57) ABSTRACT

A data-driving a liquid crystal display includes a first multiplexer array for alternately changing a supplying sequence of time-divided pixel data and time-divided pixel data, a second multiplexer array for alternately outputting the time-divided pixel data with an unshifted output channel of the time-divided pixel data and outputting the time-divided pixel data shifted to the right side by one channel in response to a control signal, a digital-to-analog converter array converting the time-divided pixel data into analog pixel signals having a polarity opposite to the pixel data of adjacent channels, a third multiplexer array for alternately outputting the pixel signals with an unshifted output channel of the pixel signals and outputting the pixel signals shifted to the left side by one channel in response to the control signal, and a demultiplexer array for alternately changing a supplying sequence of the time-divided pixel signals for each horizontal period and each frame.

16 Claims, 28 Drawing Sheets

R G B R G B R G B

R G B R G B R G B

R G B R G B R G B

R G B R G B R G B

R G B R G B R G B

R G B R G B R G B

R G B R G B R G B

APPARATUS AND METHOD DATA-DRIVING FOR LIQUID CRYSTAL DISPLAY DEVICE

This application claims the benefit of the Korean Patent Application No. P2002-076366 filed on Dec. 3, 2002, which is hereby incorporated by reference.

BACKGROUND OF THE INVENTION

1. Field of the Invention

The present invention relates to a liquid crystal display device, and more particularly, to an apparatus and method for data-driving a liquid crystal display device. Although the present invention is suitable for a wide scope of applications, it is particularly suitable for reducing the number of data driver integrated circuits for driving data lines on a time-division basis.

2. Discussion of the Related Art

Generally, a liquid crystal display (LCD) device controls light transmittance of a liquid crystal using an electric field to display a picture. To this end, the LCD device includes a liquid crystal display panel having liquid crystal cells arranged in an active matrix type, and a driving circuit for driving the liquid crystal display panel.

An LCD device according to the related art, as shown in FIG. 1, includes data-driving IC's 4 connected through data tape carrier packages (TCP's) 6 to a liquid crystal display panel 2, and gate driving IC's 8 connected through gate TCP's 10 to the liquid crystal display panel 2.

More specifically, the liquid crystal display panel 2 includes a thin film transistor TFT formed at an intersection of a gate line and a data line, and a liquid crystal cell connected to the TFT. A gate electrode of the TFT is connected to one of the gate lines being vertical lines, and a source electrode is connected to one of the data lines being horizontal lines. Such a TFT responds to a scanning signal from the gate line to supply a pixel signal from the data line to the liquid crystal cell. The liquid crystal cell includes a pixel electrode connected to a drain electrode of the TFT and a common electrode facing into the pixel electrode with a liquid crystal therebetween. Such a liquid crystal cell responds to the pixel signal supplied to the pixel electrode to drive the liquid crystal, thereby controlling its light transmittance.

Each of the gate driving IC's 8 is mounted on the gate TCP 10. The gate driving IC's 8 mounted on the gate TCP 10 are electrically connected to the corresponding gate pads of the liquid crystal display panel 2 through the gate TCP 10. The gate driving IC's 8 sequentially drive the gate lines of the liquid crystal display panel 2 for each horizontal period 1H.

Each of the data-driving IC's 4 is mounted on the data TCP 6. The data-driving IC's 4 mounted on the data TCP 6 are electrically connected to the corresponding data pads of the liquid crystal display panel 2 through the data TCP 6. The data-driving IC's 4 convert digital pixel data into an analog pixel signal and supply to the data lines of the liquid crystal display panel 2 for each horizontal period 1H.

To this end, as shown in FIG. 2, each of the data-driving IC's 4 includes a shift register 12 for applying a sequential sampling signal, first and second latch arrays 16 and 18 for latching and outputting a pixel data VD in response to the sampling signal, a first multiplexer (MUX1) array 15 arranged between the first and second latch arrays 16 and 18, a digital-to-analog converter (DAC) array 20 for converting the pixel data from the second latch array 18 into a pixel signal, a buffer array 26 for buffering and outputting the pixel signal from the DAC array 20, and a second multiplexer (MUX2) array 30 for selecting a path of an output of the buffer array 26. Further, the data-driving IC 4 includes a data register 34 for interfacing pixel data (R, G, and B) from a timing controller (not shown), and a gamma voltage part 36 for supplying positive and negative gamma voltages required in the DAC array 20.

Each data-driving IC 4 having the configuration as mentioned above has n channel (e.g., 384 or 480 channel) data outputs to drive n data lines. FIG. 2 illustrates only 6 channels D1 to D6 of the n channels of the data-driving IC 4.

The data register 34 interfaces the pixel data from the timing controller and applies the pixel data to the first latch array 16. Particularly, the timing controller divides the pixel data into even pixel data RGBeven and odd pixel data RGBodd for the purpose of reducing a transmission frequency and supplies the divided pixel data through each transmission line to the data register 34. The data register 34 outputs the input even and odd pixel data RGBeven and RGBodd to the first latch array 16 over each transmission line. Herein, each of the even pixel data RGBeven and the odd pixel data RGBodd includes red(R), green(G), and blue(B) pixel data.

The gamma voltage part 36 further divides a plurality of gamma reference voltages from a gamma reference voltage generator (not shown) for each gray level and output the divided voltages.

The shift register array 12 generates a plurality of sequential sampling signals and applies the sampling signals to the first latch array 16. To this end, the shift register array 12 is comprised of n/6 shift registers 14. The shift register 14 at the first stage in FIG. 2 shifts a source start pulse SSP from the timing controller in response to a source sampling clock signal SSC to output the shifted source start pulse as a sampling signal. At the same time, the shift register 14 applies the sampling signal to the shift register 14 at the next stage as a carry signal CAR. The source start pulse SSP is applied for each horizontal period 1H, as shown in FIGS. 3A and 3B, and is shifted every source sampling clock signal SSC to be outputted as a sampling signal.

The first latch array 16 samples and latches the pixel data RGBeven and RGBodd from the data register 34 by a certain unit in response to the sampling signal from the shift register array 12. The first latch array 16 consists of n first latches 13 for latching n pixel data R, G, and B, each of which has a size corresponding to the bit number (i.e., 3 bits or 6 bits) of the pixel data R, G, and B. Such a first latch array 16 samples and latches the even pixel data RGBeven and the odd pixel data RGBodd (i.e., each 6 pixel data) for each sampling signal, and then outputs the latched data simultaneously.

The MUX1 array 15 determines a path of the pixel data R, G, and B supplied from the first latch array 16 in response to a polarity control signal POL from the timing controller. To this end, the MUX1 array 15 includes (n−1) MUX1s 17. Each of the MUX1s 17 receives output signals of the two adjacent first latches 13 to selectively output the signals in response to the polarity control signal POL. Herein, the outputs of the remaining first latches 13 excluding the first and last first latches 13 are commonly inputted to the two adjacent MUX1s 17. The outputs of the first and last first latches 13 are commonly inputted to the second latch array 18 and the MUX1 17. The MUX1 array 15 having the configuration as mentioned above allows the pixel data R, G, and B from each first latch 13 to be advanced into the second latch array 18 as they are, or to be progressed into the second latch array 18 with being shifted toward the right side by one position in response to the polarity control signal POL. The polarity control signal POL has a polarity inverted for each horizontal period 1H, as shown in FIGS. 3A and 3B. As a result, the MUX1 array 15 allows each pixel data R, G, and B from the first latch array 16 to be outputted through the second latch array 18 to a positive (P) DAC 22 or a negative (N) DAC 24 of the DAC array 20 in response to the polarity control signal POL, thereby controlling the polarities of the pixel data R, G, and B.

The second latch array 18 simultaneously latches the inputted pixel data R, G, and B through the MUX1 array 15, from the first latch array 16 in response to a source output enable signal SOE from the timing controller, and then outputs the latched pixel data. Particularly, the second latch array 18 includes (n+1) second latches 19 in consideration of the pixel data R, G, and B from the first latch array 16 inputted with being shifted to the right. The source output enable signal SOE is generated for each horizontal period 1H, as shown in FIGS. 3A and 3B. The second latch array 18 simultaneously latches the pixel data R, G, and B inputted at the rising edge of the source output enable signal SOE, and simultaneously outputs the latched pixel data at the falling edge thereof.

The DAC array 20 converts the pixel data R, G, and B from the second latch array 18 into pixel signals with the aid of positive and negative gamma voltages GH and GL from the gamma voltage part 36 to output the pixel signals. To this end, the DAC array 20 includes (n+1) PDAC's 22 and (n+1) NDAC's 24, which are alternately arranged in parallel to each other. The PDAC 22 converts the pixel data R, G, and B from the second latch array 18 into positive pixel signals using the positive gamma voltages GH. On the other hand, the NDAC 24 converts the pixel data R, G, and B from the second latch array 18 into negative pixel signals using the negative gamma voltages GL. Each of (n+1) buffers 28 is included in the buffer array 26 buffers and outputs a pixel signal from each of the PDAC's 22 and the NDAC's 24 of the DAC array 20.

The MUX2 array 30 determines a path of each pixel signal from the buffer array 26 in response to the polarity control signal POL from the timing controller. To this end, the MUX2 array 30 includes n MUX2s 32. Each of the MUX2s 32 selects any one output of the two adjacent buffers 28 in response to the polarity control signal POL and outputs the selected signal to the corresponding data line DL. Herein, the outputs of the remaining buffers 28 excluding the first and last buffers 28 are commonly inputted to the two adjacent MUX2s. The MUX2 array 30 having the configuration as mentioned above allows the pixel signals from the buffers 28 excluding the last buffer 28 to be outputted to the data lines D1 to D6 as they are at a corresponding one to one relationship in response to the polarity control signal POL. Further, the MUX2 array 30 allows the pixel signals from the remaining buffers 28 excluding the first buffer 28 to be outputted to the data lines D1 to D6 with being shifted toward the left side by one position at a corresponding one to one relationship in response to the polarity control signal POL. The polarity control signal POL has a polarity inverted for each horizontal period 1H, as shown in FIGS. 3A and 3B, similar to the MUX1 array 15. As mentioned above, the MUX2 array 30, along with the MUX1 array 15, determines polarities of the pixel signals applied to the data lines D1 to D6 in response to the polarity control signal POL. As a result, the pixel signal applied through the MUX2 array 30 to each data line D1 to D6 has a polarity opposite to the adjacent pixel signals. In other words, as shown in FIGS. 3A and 3B, the pixel signals outputted to the odd data lines DLodd, such as D1, D3 and D5, etc., have polarities opposite to the pixel signals outputted to the even data lines DLeven, such as D2, D4 and D6, etc. Polarities of the odd data lines DLodd and the even data lines DLeven are inverted for each horizontal period 1H at which the gate lines GL1, GL2, GL3, . . . are sequentially driven, and are inverted for each frame.

As described above, each of the related art data-driving IC's 4 requires (n+1) DAC's and (n+1) buffers so as to drive n data lines. As a result, the related art data-driving IC's 4 have disadvantages in that the configuration are complex and the manufacturing costs are relatively high.

SUMMARY OF THE INVENTION

Accordingly, the present invention is directed to an apparatus and method for data-driving a liquid crystal display device that substantially obviates one or more of problems due to limitations and disadvantages of the related art.

Another object of the present invention is to provide an apparatus and method for data-driving a liquid crystal display device that is adaptive for reducing the number of data driver integrated circuits and improving its picture display quality by driving data lines on a time-division basis.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an apparatus for data-driving a liquid crystal display device includes a first multiplexer array performing a time-division on inputted pixel data into odd-numbered and even-numbered pixel data, alternately changing a supplying sequence of the time-divided pixel data for at least one horizontal period and one frame, and supplying the time-divided pixel data, a second multiplexer array alternately outputting the time-divided pixel data with an unshifted output channel of the time-divided pixel data and outputting the time-divided pixel data shifted to the right side by one channel for at least two horizontal periods in response to a polarity control signal having a polarity inverted for the at least two horizontal periods, a digital-to-analog converter array converting the time-divided pixel data into analog pixel signals having a polarity opposite to the pixel data of adjacent channels, a third multiplexer array alternately outputting the pixel signals with an output channel of the pixel signals and outputting the pixel signals shifted to the left side by one channel for the at least two horizontal periods in response to the polarity control signal, and a demultiplexer array performing a time-division on data lines into odd-numbered and even-numbered data lines and supplying the pixel signals to the time-divided data lines, and alternately changing a supplying sequence of the time-divided pixel signals for each horizontal period and each frame.

The data-driving apparatus further includes a shift register array sequentially generating sampling signals, a latch array sequentially latching the inputted pixel data in response to the sampling signals and simultaneously outputting the latched pixel data to the first multiplexer array, and a buffer array buffering the pixel signals from the digital-to-analog converter array and supplying the buffered pixel signals to the third multiplexer array.

The digital-to-analog converter array includes total (n+1) number of positive and negative digital-to-analog converters when the demultiplexer array drives 2n data lines, and the positive digital-to-analog converters and the negative digital-to-analog converters are alternately arranged, wherein n is a positive integer.

Herein, the first multiplexer array includes at least n number of first multiplexers performing a time-division on 2n number of pixel data into the odd-numbered and even-numbered pixel data and supplying the time-divided pixel data, the second multiplexer array includes at least (n−1) number of second multiplexers selecting one of outputs of two adjacent multiplexers of the first multiplexers, the third multiplexer array includes at least n number of third multiplexers selecting one of outputs of two adjacent digital-to-analog converters of the digital-to-analog converters, the demultiplexer array includes at least n number of demultiplexers dividing outputs of the third multiplexers and supplying the divided outputs to odd-numbered and even-numbered data lines, the outputs of the first multiplexers are commonly inputted to two adjacent multiplexers of the second multiplexers, and the outputs of the digital-to-analog converters are commonly inputted to two adjacent multiplexers of the third multiplexers, wherein n is a positive integer.

Herein, the at least n number of the first multiplexers perform a time-division on the odd-numbered and even-numbered pixel data in response to first and second selection control signals and output the time-divided pixel data, and the at least n number of the demultiplexers perform a time-division on the odd-numbered and even-numbered data line in response to the first and-second selection control signals and output the pixel signals from the third multiplexers, wherein n is a positive integer.

Herein, the first and second selection control signals have polarities opposite to each other, and the polarities of the first and second selection control signals are inverted for each horizontal period or for each of two horizontal periods.

In another aspect of the present invention, a data-driving apparatus for a liquid crystal display device includes a data register alternately outputting inputted pixel data with an unshifted output channel of the inputted pixel data and outputting the inputted pixel data shifted by two channels for each of at least two horizontal periods, a first multiplexer array performing a time-division on the pixel data from the data register into odd-numbered and even-numbered pixel data, alternately changing a supplying sequence of the time-divided pixel data for each horizontal period and each frame, and supplying the time-divided pixel data, a digital-to-analog converter array converting the time-divided pixel data into analog pixel signals having a polarity opposite to the pixel data of adjacent channels, a second multiplexer array alternately outputting the pixel signals with an unshifted output channel of the pixel signals and outputting the pixel signals shifted to the left side by one channel for each of the at least two horizontal periods in response to a polarity control signal having a polarity inverted for each of the at least two horizontal periods, and a demultiplexer array performing a time-division on data lines into odd-numbered and even-numbered data lines, supplying the pixel signals to the odd-numbered and even-numbered data lines, and alternately changing a supplying sequence of the pixel signals for at least each horizontal period and each frame.

The data-driving apparatus further includes a shift register array sequentially generating sampling signals, a latch array sequentially latching the inputted pixel data from the data register in response to the sampling signals and simultaneously outputting the latched pixel data to the first multiplexer array, and a buffer array buffering the pixel signals from the digital-to-analog converter array and supplying the buffered pixel signals to the second multiplexer array.

The digital-to-analog converter array includes total (n+1) number of positive and negative digital-to-analog converters when the demultiplexer array drives 2n data lines, and the positive digital-to-analog converters and the negative digital-to-analog converters are alternately arranged, wherein n is a positive integer.

Herein, the first multiplexer array includes at least n number of first multiplexers performing a time-division on 2n number of pixel data into the odd-numbered and even-numbered pixel data in response to a selection control signal and supplying the time-divided pixel data, the second multiplexer array includes at least n number of second multiplexers selecting one of outputs of two adjacent digital-to-analog converters of the digital-to-analog converters in response to a polarity control signal, the demultiplexer array includes at least n number of demultiplexers dividing outputs of the second multiplexers in response to the selection control signal and supplying the divided outputs to the odd-numbered and even-numbered data lines, and the outputs of each of the digital-to-analog converters are commonly inputted to at least two of the second multiplexers, wherein n is a positive integer.

Herein, the selection control signal has a polarity inverted for each horizontal period or for each of two horizontal periods.

In another aspect of the present invention, a data-driving method for a liquid crystal display device includes performing a time-division on inputted pixel data into odd-numbered and even-numbered pixel data in response to a selection control signal, alternately outputting the time-divided pixel data with an unshifted output channel of the time-divided pixel data and outputting the time-divided pixel data shifted to the right side by one channel for each of at least two horizontal periods in response to a polarity control signal having a polarity inverted for each of the at least two horizontal periods, converting the time-divided pixel data into analog pixel signals having a polarity opposite to the pixel data of adjacent channels, alternately outputting the pixel signals with an unshifted output channel of the pixel signals and outputting the pixel signals shifted to the left side by one channel for each of the at least two horizontal periods, performing a time-division on data lines into odd-numbered and even-numbered data lines in response to the selection control signal and supplying the pixel signals to the time-divided data lines, and alternately changing a supplying sequence of the time-divided pixel data and a supplying sequence of the pixel signals to the time-divided data lines for at least each horizontal period and each frame.

In a further aspect of the present invention, a data-driving method for a liquid crystal display device includes alternately outputting inputted pixel data with an unshifted output channel of the inputted pixel data and outputting the inputted pixel data by two channels for each of at least two horizontal periods, performing a time-division on the pixel data into odd-numbered and even-numbered pixel data in response to a selection control signal, and supplying the time-divided pixel data, converting the time-divided pixel data into analog pixel signals having a polarity opposite to the pixel data of adjacent channels, alternately outputting the pixel signals with an unshifted output channel of the pixel signals and outputting the pixel signals shifted to the left side by one channel for each of the at least two horizontal periods in response to a polarity control signal having polarity inverted for each of the at least two horizontal periods, performing a time-division on data lines into odd-numbered and even-numbered data lines in response to the selection control signal and supplying the pixel signals to the time-divided data lines, and alternately changing a supplying sequence of the time-divided pixel data and a supplying sequence of the pixel signals to the time-divided data lines for at least each horizontal period and each frame.

The data-driving method further includes, sequentially generating sampling signals prior to the performing a time-division on the pixel data and supplying the time-divided pixel data, sequentially latching the pixel data in response to the sample signals, and simultaneously supplying the latched pixel data, and buffering the pixel signals after converting into the pixel signals.

In the data-driving method, the selection control signal has a polarity inverted for each horizontal period or for each of two horizontal periods.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

With reference to FIGS. 4 to 16B, the present invention will be explained as follows.

Figure 1:
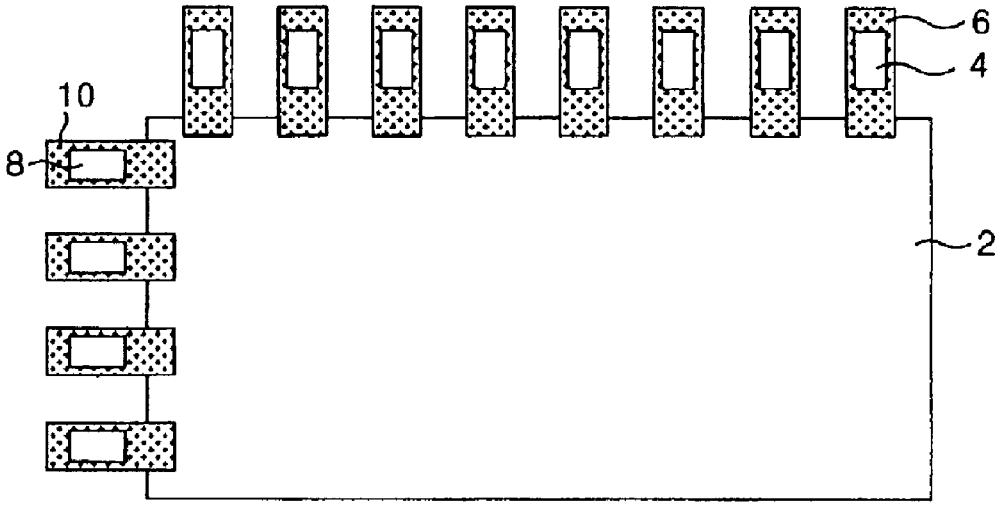
FIG. 1 RELATED ART
FIG. 1 is a schematic view showing a configuration of a related art liquid crystal display.
Figure 2:
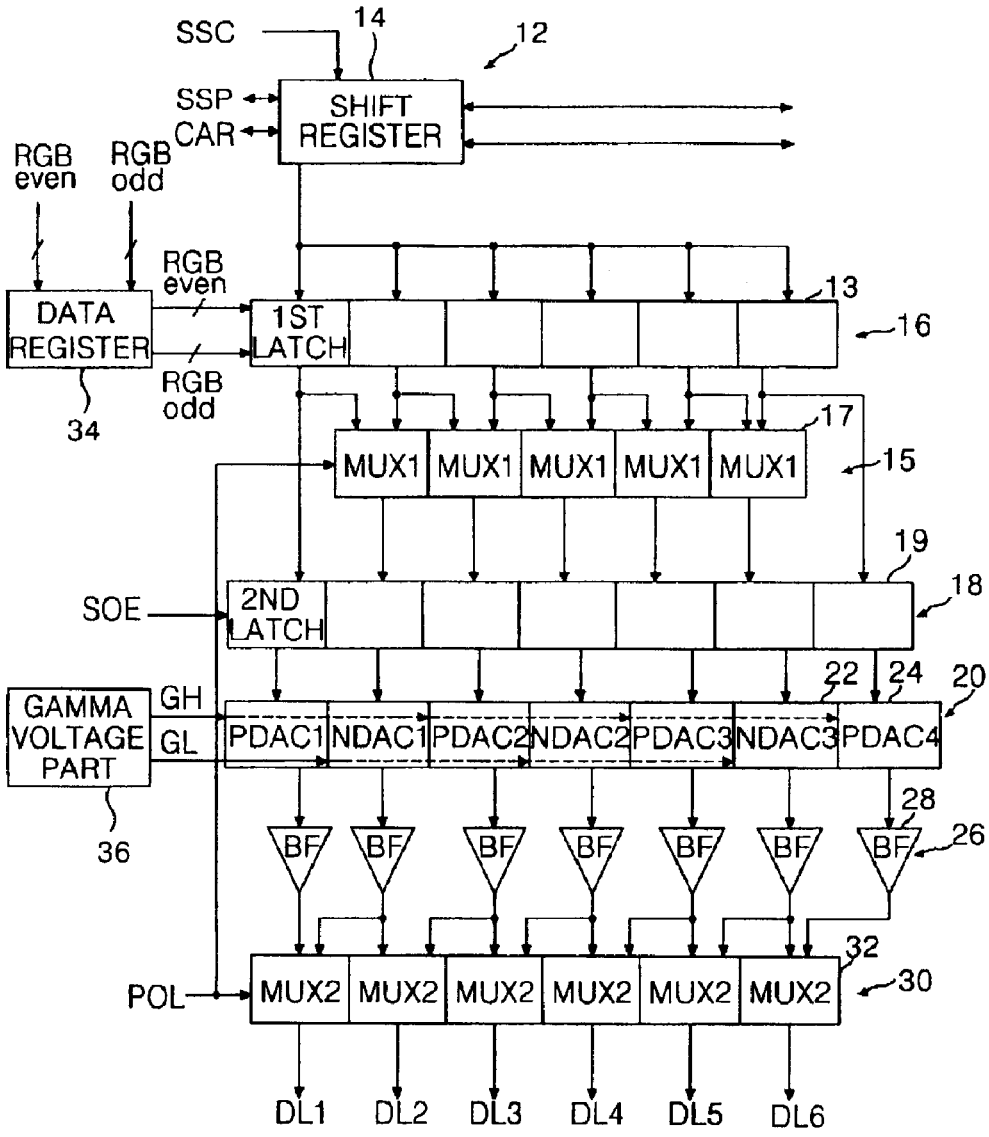
FIG. 2 RELATED ART
FIG. 2 is a detailed block diagram of the data-driving integrated circuit of FIG. 1.
Figure 3A:
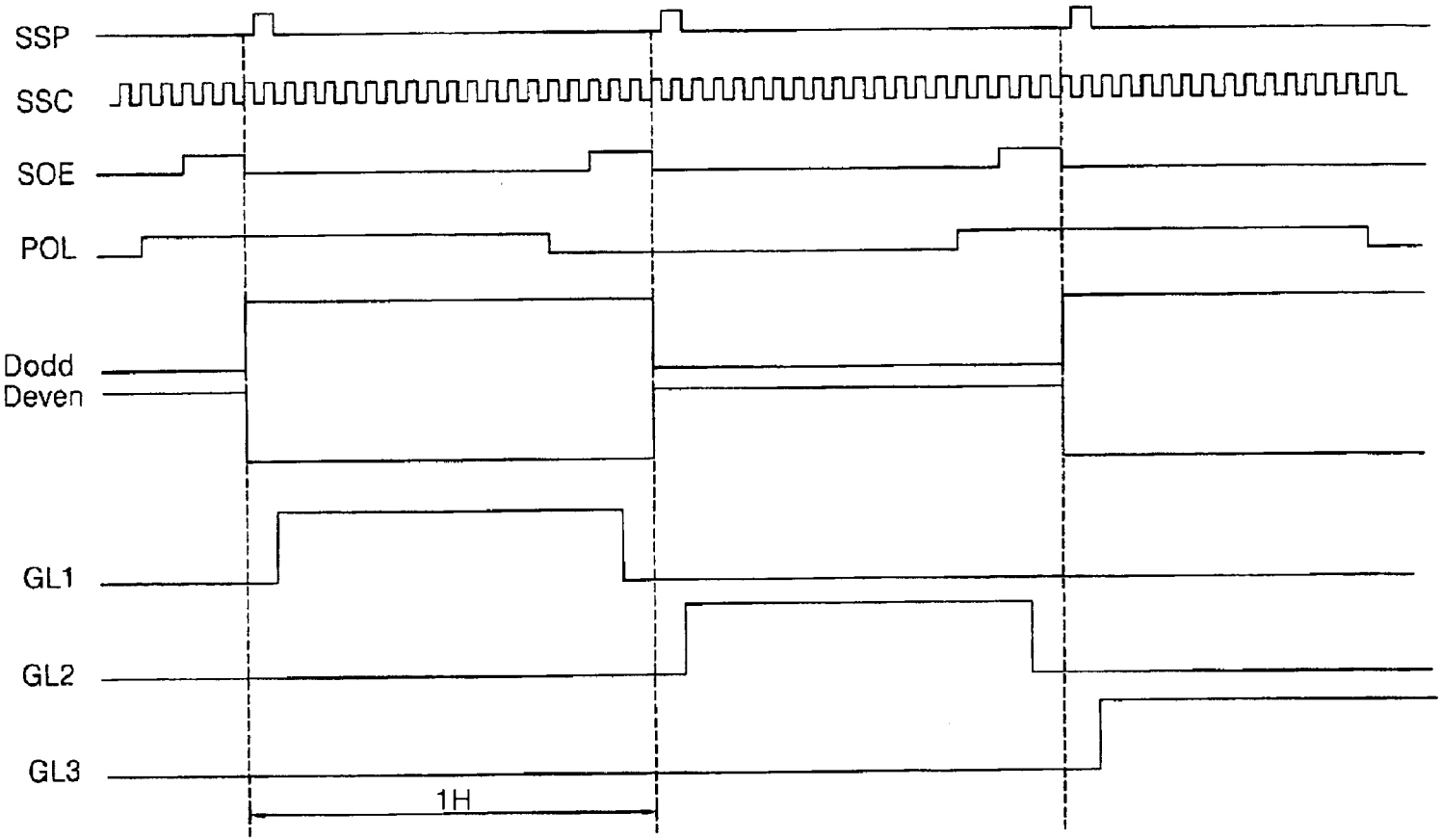
FIG.3A RELATED ART
FIGS. 3A and 3B are driving waveform diagrams of odd and even frames of the data-driving IC of FIG. 2.
Figure 3B:
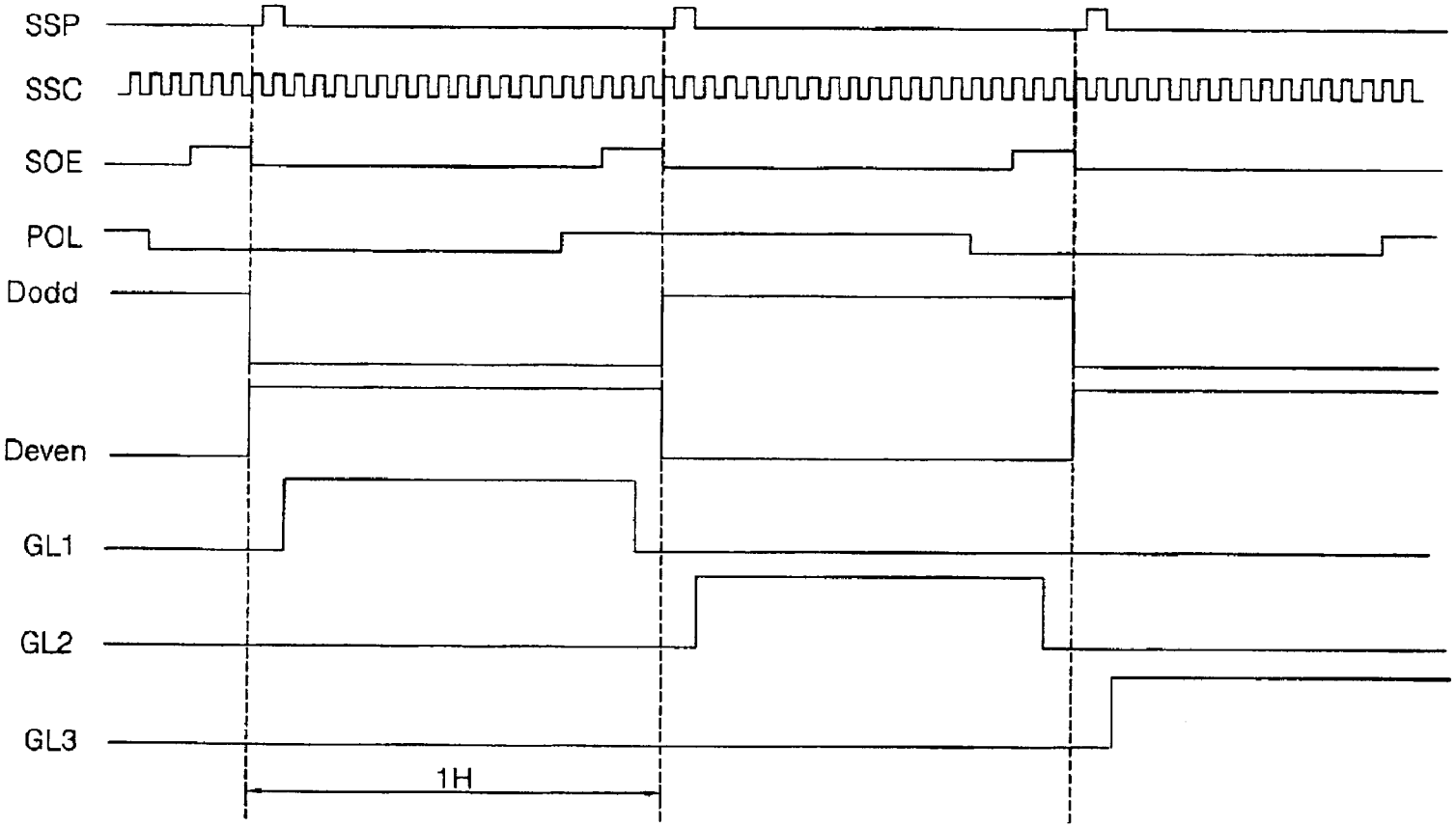
FIG.3B RELATED ART
Figure 4:
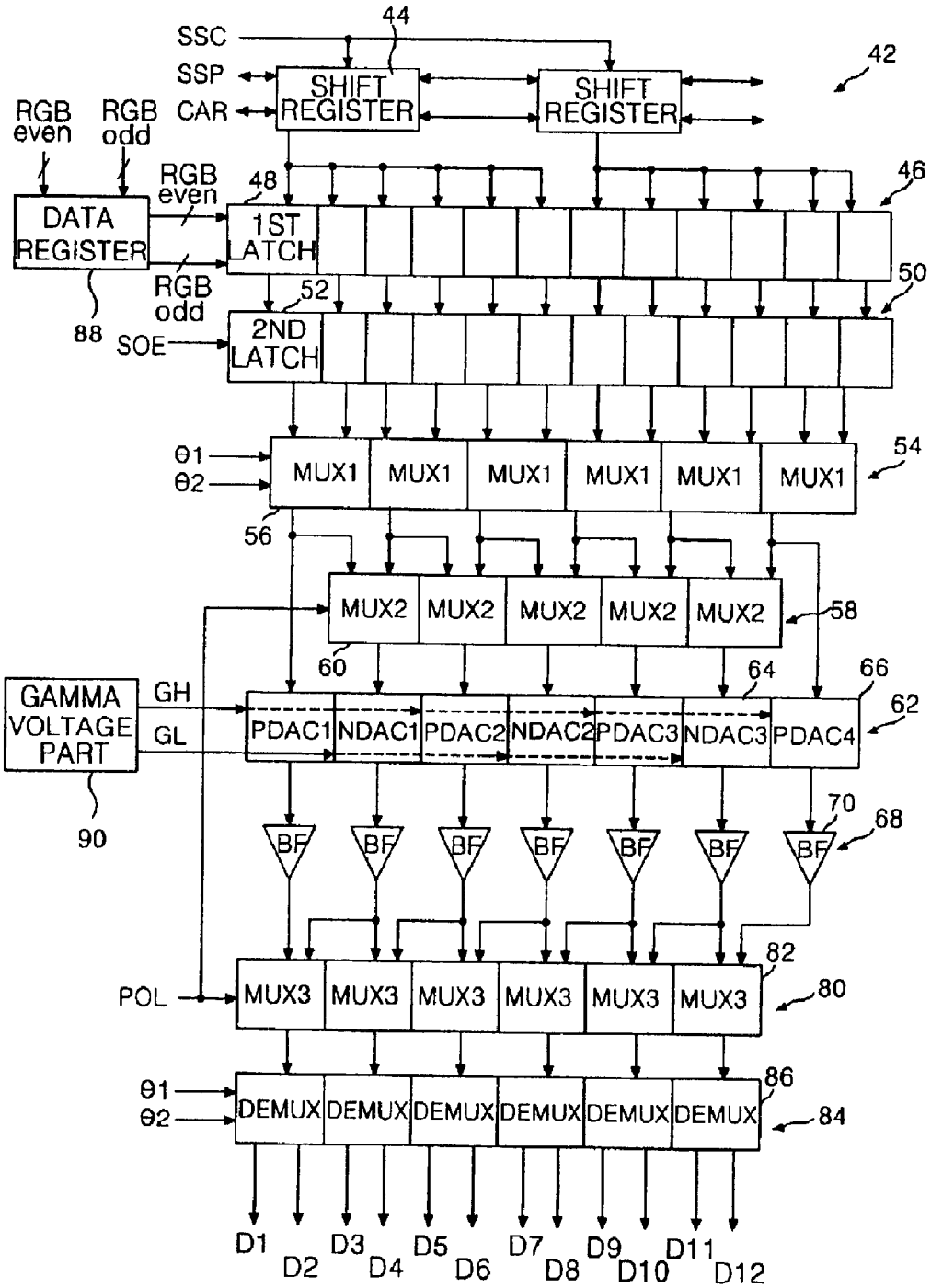
FIG. 4 is a detailed block diagram showing a configuration of a data-driving IC of a liquid crystal display device according to a first embodiment of the present invention.
Figure 5A:
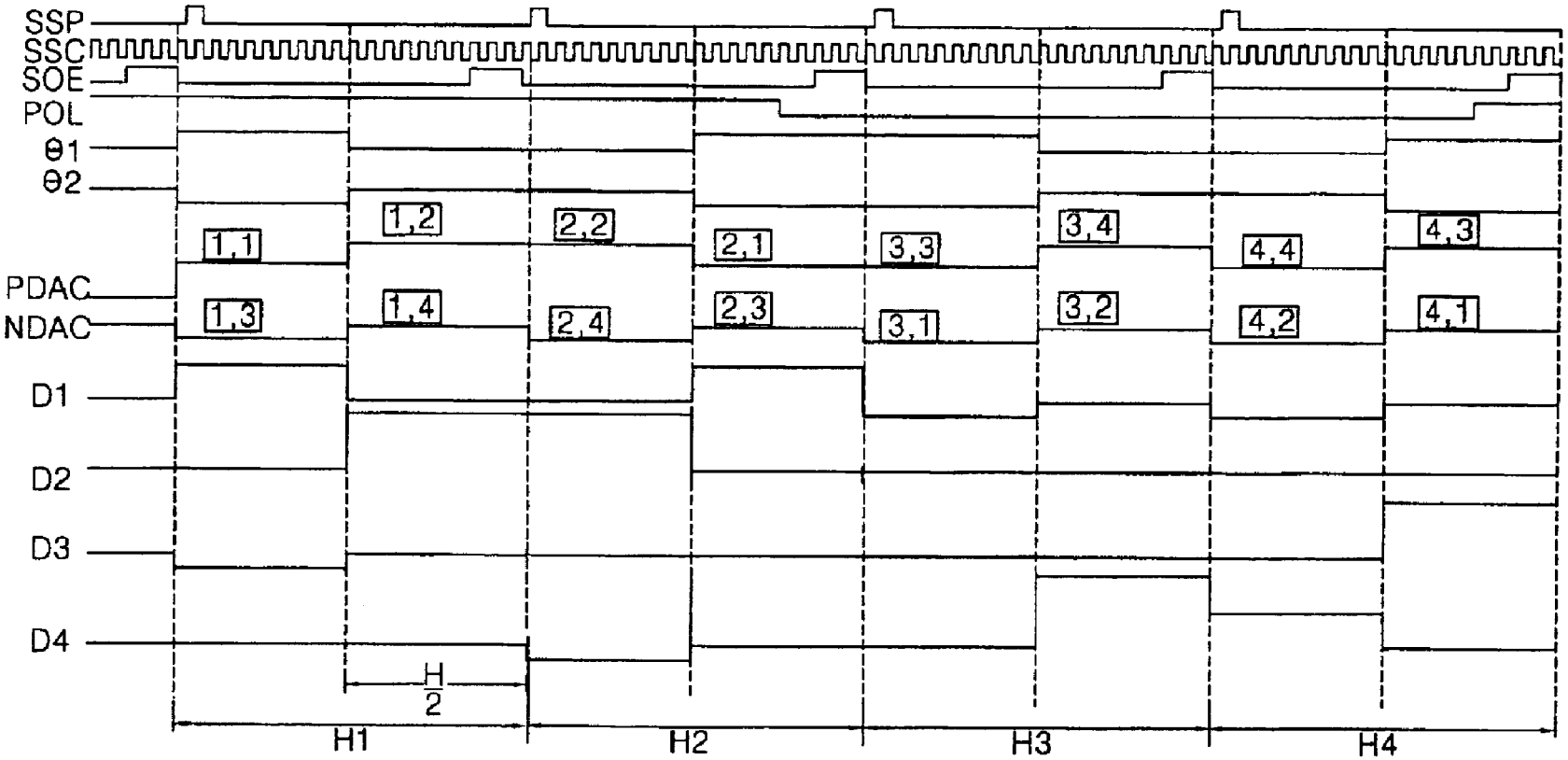
FIGS. 5A and 5B are driving waveform diagrams of odd and even frames of the data-driving IC of FIG. 4.
Figure 5B:
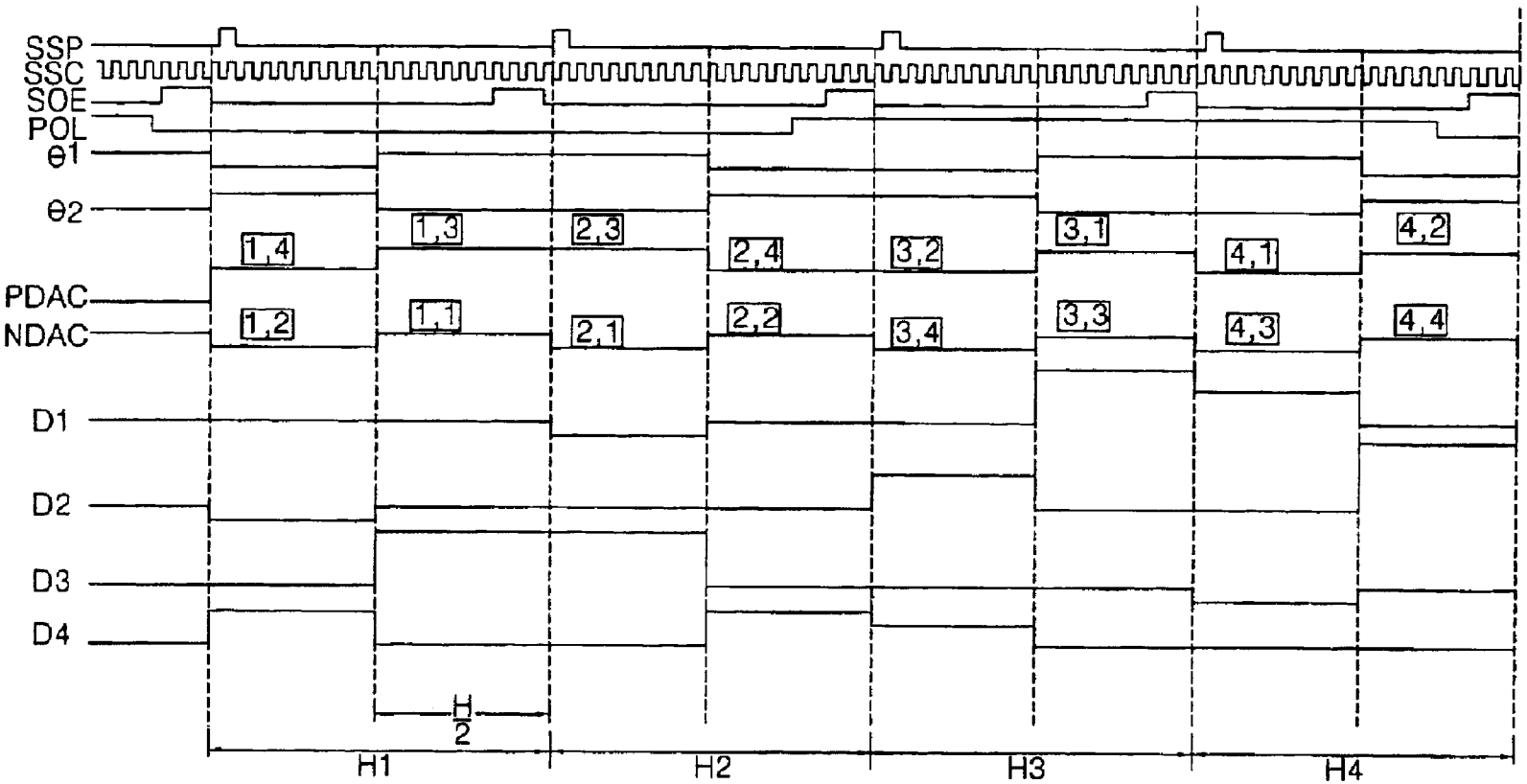

In FIG. 4 is a detailed block diagram of a configuration of a data-driving IC of a liquid crystal display device according to a first embodiment of the present invention. FIGS. 5A and 5B are driving waveform diagrams of odd and even frames of the data-driving IC of FIG. 4.

The data-driving IC, as shown in FIG. 4, includes a shift register array 42 for applying a sequential sampling signal, first and second latch arrays 46 and 50 for latching and outputting pixel data R, G, and B in response to the sampling signal, a first multiplexer (MUX1) array 54 for time-dividing the pixel data R, G, and B from the second latch array 50 and outputting the time-divided pixel data, a second multiplexer (MUX2) array 58 for controlling a path of the pixel data R, G, and B from the MUX1 array 54, a digital-to-analog converter (DAC) array 62 for converting the pixel data R, G, and B from the MUX2 array 58 into pixel signals, a buffer array 68 for buffering and outputting the pixel signals from the DAC array 62, a third multiplexer (MUX3) array 80 for controlling a path of an output of the buffer array 68, and a demultiplexer (DEMUX) array 84 for time-dividing the pixel signals from the MUX3 array 80 and outputting into data lines D1 to D2*n*. Further, the data-driving IC, shown in FIG. 4, includes a data register 88 for interfacing pixel data R, G, and B from a timing controller (not shown), and a gamma voltage part 90 for supplying positive and negative gamma voltages required in the DAC array 62.

Each data-driving IC having the above-described configuration performs a time-divisional driving of the DAC array 62 using the MUX1 array 54 and the DEMUX array 84, thereby driving 2n data lines, which are twice the data lines of the related art explained above, using (n+1) DAC's 64 and 66 and (n+1) buffers 70. The present data-driving IC has 2n channel data outputs so as to drive 2n data lines. However, FIG. 4 illustrates only 12 channels D1 to D12 of the 2n channels of the data-driving IC when n is 6, for example.

And, the data-driving IC alternately changes the charging sequence of the pixel signals for at least each horizontal period and each frame, and at the same time, drives the data lines by a vertical horizontal two-dot inversion scheme, thereby improving a picture quality of an image.

The data register 88 interfaces the pixel data from the timing controller to apply the pixel data to the first latch array 46. Particularly, the timing controller divides the pixel data into even pixel data RGBeven and odd pixel data RGBodd for the purpose of reducing a transmission frequency and supplies the divided pixel data through each transmission line to the data register 88. The data register 88 outputs the input even and odd pixel data RGBeven and RGBodd to the first latch array 46 through each transmission line. Herein, each of the even pixel data RGBeven and the odd pixel data RGBodd includes red(R), green(G), and blue(B) pixel data.

The gamma voltage part 90 further divides a plurality of gamma reference voltages from a gamma reference voltage generator (not shown) for each gray level to output the divided gamma reference voltages.

The shift register array 42 generates and applies sequential sampling signals to the first latch array 46. To this end, the shift register array 46 is comprised of 2n /6 (herein, n=6) shift registers 44. The shift register 44 at the first stage shown in FIG. 4 shifts a source start pulse SSP from the timing controller in response to a source sampling clock signal SSC and outputs the shifted source start pulse as a sampling signal. At the same time, the shift register 44 applies the shifted source start pulse to the shift register 44 at the next stage as a carry signal CAR. The source start pulse SSP is applied for each horizontal period, as shown in FIGS. 5A and 5B, and is shifted for each source sampling clock signal SSC to be outputted as a sampling signal.

The first latch array 46 samples and latches the pixel data RGBeven and RGBodd from the data register 88 by a certain unit in response to the sampling signal from the shift register array 42. The first latch array 46 consists of 2n first latches 48 for latching 2n (herein, for example, n=6) pixel data R, G, and B, each of which has a size corresponding to the bit number (i.e., 3 bits or 6 bits) of the pixel data R, G, and B. Such a first latch array 46 samples and latches the even pixel data RGBeven and the odd pixel data RGBodd (i.e., each 6 pixel data) for each sampling signal, and then outputs the latched data simultaneously.

The second latch array 50 simultaneously latches the pixel data R, G, and B from the first latch array 46 in response to a source output enable signal SOE from the timing controller, and then outputs the latched data. The second latch array 50 includes 2n (herein, for example, n=6) second latches 52 similar to the first latch array 46. The source output enable signal SOE is generated for each horizontal period, as shown in FIGS. 5A and 5B.

The MUX1 array 54 performs an n time-division on 2n (herein, for example, n=2) pixel data from the second latch array 50 for each ½ horizontal period to output the time-divided pixel data in response to first and second selection control signals θ1 and θ2 from the timing controller. In this case, the MUX1 array 54 alternately changes the output sequence of the pixel data for at least each horizontal period and each frame, wherein the pixel data is outputted by the ½ horizontal period. To this end, the MUX1 array 54 consists of n MUX1s 56, each of which selects any one output of the two adjacent second latches 52 in response to the first or second selection control signals θ1 and θ2. In other words, each of the MUX1s 56 time-divides the outputs of the two adjacent second latches 52 for each ½ period to apply the time-divided output.

Odd-numbered MUX1s 56 of the MUX1s 56 select any one of the two adjacent second latches 52 in response to the first selection control signal θ1 and apply the output of the selected second latch, even-numbered MUX1s 56 select any one of the two adjacent second latches 52 in response to the second selection control signal θ2 and apply the output of the selected second latch. Herein, the first and second selection signals θ1 and θ2 have their polarities opposite to each other, as shown in FIGS. 5A and 5B. And the first and second selection signals θ1 and θ2 have their polarities inverted for each horizontal period and each frame. Accordingly, each of the multiplexers 56 alternately changes the sequence of selecting and outputting the outputs of the second latches 52 for at least each horizontal period and each frame.

For example, the first MUX1 56 selects to output a first pixel data from the first second latch 52 at the first half of the $(m-1)^{th}$ horizontal period, and a second pixel data from the second second latch 52 at the second half, in response to the first selection control signal θ1. At the same time, the second MUX1 56 selects to output a third pixel data from the third second latch 52 at the first half, and a fourth pixel data from the fourth second latch 52 at the second half, in response to the second selection control signal θ2. The first MUX1 56 selects to output the second pixel data from the second second latch 52 at the first half of the $m^{th}$ horizontal period, and the first pixel data from the first second latch 52 at the second half. At the same time, the second MUX1 56 selects to output the fourth pixel data from the fourth second latch 52 at the first half, and the third pixel data from the third second latch 52 at the second half.

The MUX2 array 58 determines a path of the pixel data R, G, and B supplied from the MUX1 array 54 in response to a polarity control signal POL from the timing controller. To this end, the MUX2 array 54 includes (n−1) MUX2s 60. Each of the MUX2s 60 receives the output signals of the two adjacent MUX1s 56 to selectively output the received signals in response to the polarity control signal POL. Herein, the outputs of the remaining MUX1s 56 excluding the first and last MUX1s 56 are commonly inputted to the two adjacent MUX2s 60. The outputs of the first and last MUX1s 56 are commonly inputted to the PDAC 66 and the MUX2 60.

More specifically, the MUX2 array 58 allows the pixel data R, G, and B received from each MUX1 56 to be outputted to PDAC 64 or NDAC 66, which are arranged alternately in the DAC array 66, while retaining the output channel intact, or to be shifted to the right side by one channel and outputted, in accordance with the polarity control signal POL, the polarity of which is inverted for each horizontal period, as shown in FIGS. 5A and 5B.

For instance, in the $(m-2)^{th}$ and $(m-1)^{th}$ horizontal periods, the first and second pixel data outputted from the first MUX1 56 are directly supplied to the first PDAC1 66 without passing through the MUX2 60, whereas the third and fourth pixel data outputted from the second MUX1 56 are supplied to the second NDAC1 64 through the first MUX2 60. And, in the $m^{th}$ and $(m+1)^{th}$ horizontal periods, the first and second pixel data outputted from the first MUX1 56 for the polarity inversion are supplied to the second NDAC1 64 through the first MUX2 60, whereas the third and fourth pixel data outputted from the second MUX1 56 are supplied to the third PDAC2 66 through the second MUX2 60.

The DAC array 62 converts the pixel data R, G, and B from the MUX2 array 58 into pixel signals by using positive and negative gamma voltages GH and GL received from the gamma voltage part 90 to output the pixel signals. To this end, the DAC array 62 includes (n+1) PDAC's 66 and (n+1) NDAC's 64, which are alternately arranged in parallel to one another. The PDAC 66 converts the pixel data R, G, and B from the MUX2 array 58 into positive pixel signals using the positive gamma voltages GH. On the other hand, the NDAC 64 converts the pixel data R, G, and B from the MUX2 array 58 into negative pixel signals using the negative gamma voltages GL. Such PDAC 66 and NDAC 64 convert the digital pixel data inputted for each ½ horizontal period into analog pixel signals.

For instance, the PDAC1 66 converts pixel data [1,1] and [1,2] inputted time-divisionally in each of the $(m-2)^{th}$ and $(m-1)^{th}$ horizontal periods into pixel signals, as shown in FIGS. 5A and 5B, to output the converted data. At the same time, the NDAC2 also converts pixel data [1,3] and [1,4] inputted time-divisionally in each of the $(m-2)^{th}$ and $(m-1)^{th}$ horizontal periods into pixel signals, as shown in FIGS. 5A and 5B, to output the converted data. By such a DAC array 62, pixel data time-divided n by n for each ½ horizontal period are converted into pixel signals that are suitable for a vertical horizontal two-dot inversion driving and then outputted.

Each of (n+1) buffers 70 included in the buffer array 68 buffers and outputs a pixel signal from each of the PDAC's 66 and the NDAC's 64 of the DAC array 62.

The MUX3 array 80 determines a path of each pixel signal from the buffer array 68 in response to the polarity control signal POL from the timing controller. To this end, the MUX3 array 80 includes n (herein, for example, n=6) MUX3s 82. Each of the MUX3s 82 selects any one output of the two adjacent buffers 70 in response to the polarity control signal POL. Herein, the outputs of the remaining buffers 70 excluding the first and last buffers 70 are commonly inputted to the two adjacent MUX3s 82.

The MUX3 array 82 having the above-described configuration allows the pixel signals from each of the buffers 70 excluding the last buffer 70 to be outputted to each of the DEMUXs 86 while retaining the output channel intact, in response to the polarity control signal POL. Further, the MUX3 array 82 allows the pixel signals from each of the remaining buffers 70 excluding the first buffer 70 to be outputted to each of the DEMUXs 86 after shifting the pixel signals to the left side by one channel, in response to the polarity control signal POL. The polarity control signal POL, for a vertical horizontal two-dot inversion driving, has a polarity inverted for each two horizontal periods, as shown in FIGS. 5A and 5B, similar to the MUX2 array 58. As mentioned above, the MUX3 array 80, along with the MUX2 array 58, determines polarities of the pixel signals in response to the polarity control signal POL. As a result, the pixel signal outputted from the MUX3 array 80 for each ½ horizontal period has a polarity opposite to the adjacent pixel signals outputted simultaneously and has its polarity inverted for each two horizontal periods, thus being suitable for the vertical horizontal two-dot inversion driving.

The DEMUX array 84 selectively applies the pixel signals from the MUX3 array 80 to 2n data lines in response to the first and second selection control signals θ1 and θ2 from the timing controller. To this end, the DEMUX array 84 consists of n DEMUXs 86, each of which performs a time-division on the pixel signal from each MUX3 82 to apply the time-divided signal to two data lines. More specifically, the odd-numbered DEMUXs 86 performs a time-division on the output signals of the odd-numbered MUX3s 82 in response to the first selection control signal θ1 to apply the time-divided signals to two data lines. The even-numbered DEMUXs 86 performs a time-division on the outputs of the two even-numbered MUX3s 82 in response to the second selection control signal θ2 to apply them to two data lines. The first and second selection control signals θ1 and θ2, as illustrated in FIGS. 5A and 5B, have a polarity opposite to each other and inverted for each horizontal period similar to those applied to the MUX1 array 54 in order to invert, the output sequence of the pixel signals for each horizontal period and each frame.

For example, the first DEMUX 86 selectively applies an output the first MUX3 82 to the first and second data lines D1 and D2 for each ½ horizontal period in response to the first selection control signal θ1, as shown in FIGS. 5A and 5B, and alternately changes the order of outputting the pixel voltage by selecting the pixel voltage for each horizontal period and each frame. Similarly, the second DEMUX 86 selectively applies the output of the second MUX3 82 to the third and fourth data lines D3 and D4 for each ½ horizontal period in response to the second selection control signal θ2, as shown in FIGS. 5A and 5B, and alternately changes the order of outputting the pixel voltage by selecting the pixel voltage for each horizontal period and each frame.

Figure 6A:
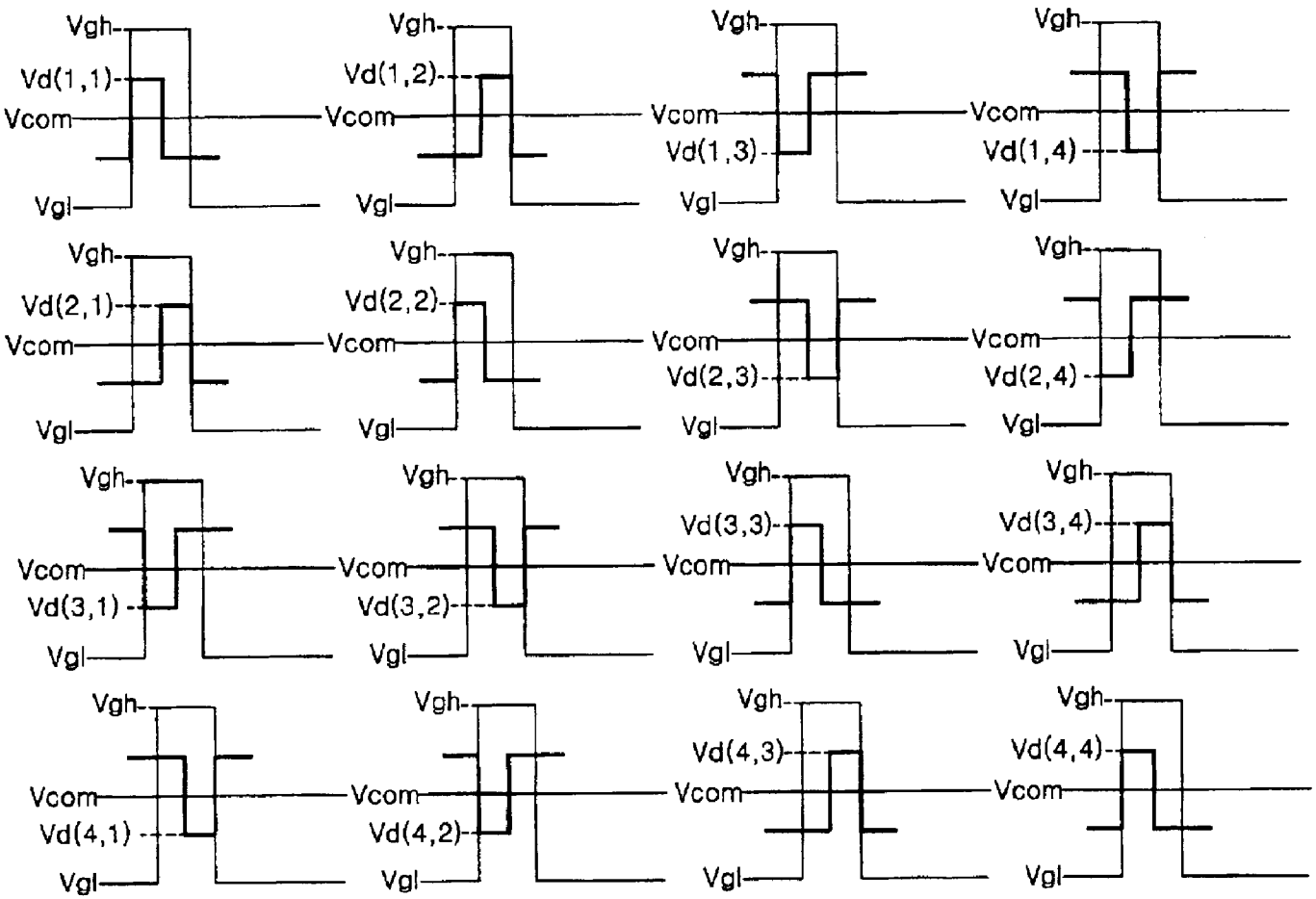
FIGS. 6A and 6B illustrate the charging characteristic of a liquid crystal cell by the driving waveform of FIGS. 5A and 5B.

Accordingly, in the odd-numbered frame as shown in FIG. 6A, a [1,1] liquid crystal cell is charged with a positive pixel signal Vd[1,1] and a [1,3] liquid crystal cell is charged with a negative pixel signal Vd[1,3] at the first half of the first horizontal period H1, and a [1,2] liquid crystal cell is charged with a positive pixel signal Vd[1,2] and a [1,4] liquid crystal cell is charged with a negative pixel signal Vd[1,4] at the second half. And then, as the charging sequence of the pixel signals is changed in the second horizontal period H2, a [2,2] liquid crystal cell is charged with a positive pixel signal Vd[2,2] and a [2,4] liquid crystal cell is charged with a negative pixel signal Vd[2,4] at the first half, and a [2,1] liquid crystal cell is charged with a positive pixel signal Vd[2,1] and a [2,3] liquid crystal cell is charged with a negative pixel signal Vd[2,3] at the second half.

Subsequently, as the charging sequence and polarity of the pixel signals are changed in the third horizontal period H3, a [3,1] liquid crystal cell is charged with a negative pixel signal Vd[3,1] and a [3,3] liquid crystal cell is charged with a positive pixel signal Vd[3,3] at the first half, and a [3,2] liquid crystal cell is charged with a negative pixel signal Vd[3,2] and a [3,4] liquid crystal cell is charged with a positive pixel signal Vd[3,4] at the second half. And then, as the charging sequence of the pixel signals is changed in the fourth horizontal period H4, a [4,2] liquid crystal cell is charged with a negative pixel signal Vd[4,2] and a [4,4] liquid crystal cell is charged with a positive pixel signal Vd[4,4] at the first half, and a [4,1] liquid crystal cell is charged with a negative pixel signal Vd[4,1] and a [4,3] liquid crystal cell is charged with a positive pixel signal Vd[4,3] at the second half.

Figure 6B:
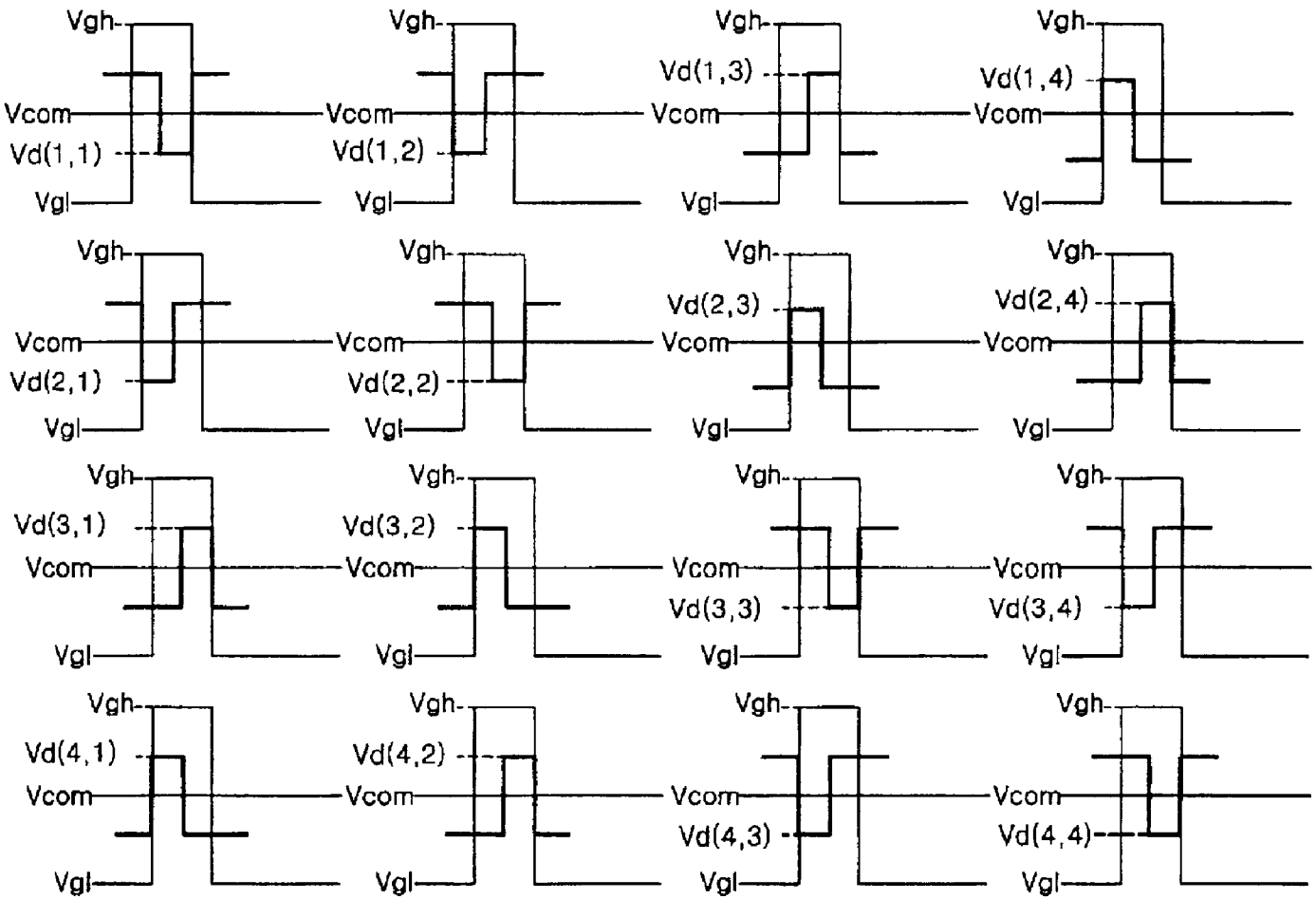

And then, in the even-numbered frame as shown in FIG. 6B, as the charging sequence and polarity of pixel signals are changed in the first horizontal period H1, the [1,2] liquid crystal cell is charged with the negative pixel signal Vd[1,2] and the [1,4] liquid crystal cell is charged with the positive pixel signal Vd[1,4] at the first half, and the [1,1] liquid crystal cell is charged with the negative pixel signal Vd[1,1] and the [1,3] liquid crystal cell is charged with the positive pixel signal Vd[1,3] at the second half. And then, as the charging sequence of the pixel signals is changed in the second horizontal period H2, the [2,1] liquid crystal cell is charged with the negative pixel signal Vd[2,1] and the [2,3] liquid crystal cell is charged with the positive pixel signal Vd[2,3] at the first half, and the [2,2] liquid crystal cell is charged with the negative pixel signal Vd[2,2] and the [2,4] liquid crystal cell is charged with the positive pixel signal Vd[2,4] at the second half.

Subsequently, as the charging sequence and polarity of the pixel signals are changed in the third horizontal period H3, the [3,2] liquid crystal cell is charged with the positive pixel signal Vd[3,2] and the [3,4] liquid crystal cell is charged with the negative pixel signal Vd[3,4] at the first half, and the [3,1] liquid crystal cell is charged with the positive pixel signal Vd[3,1] and the [3,3] liquid crystal cell is charged with the negative pixel signal Vd[3,3] at the second half. And then, as the charging sequence of the pixel signals is changed in the fourth horizontal period H4, the [4,1] liquid crystal cell is charged with the positive pixel signal Vd[4,1] and the [4,3] liquid crystal cell is charged with the negative pixel signal Vd[4,3] at the first half, and the [4,2] liquid crystal cell is charged with the positive pixel signal Vd[4,2] and the [4,4] liquid crystal cell is charged with the negative pixel signal Vd[4,4] at the second half.

The data-driving IC with such a configuration, as shown in FIG. 4, drives the data lines on a time-division basis and drives the data lines of 2n channels in use of (n+1) DAC's, so that the number of data-driving IC can be reduced to at least a half. Further, the data-driving IC alternately changes the supplying sequence (i.e., the charging sequence) of the pixel signals for at least each horizontal period and each frame, thus compensating the difference in the charging amount of pixel voltage by driving the data lines on a time-division basis.

Figure 7A:
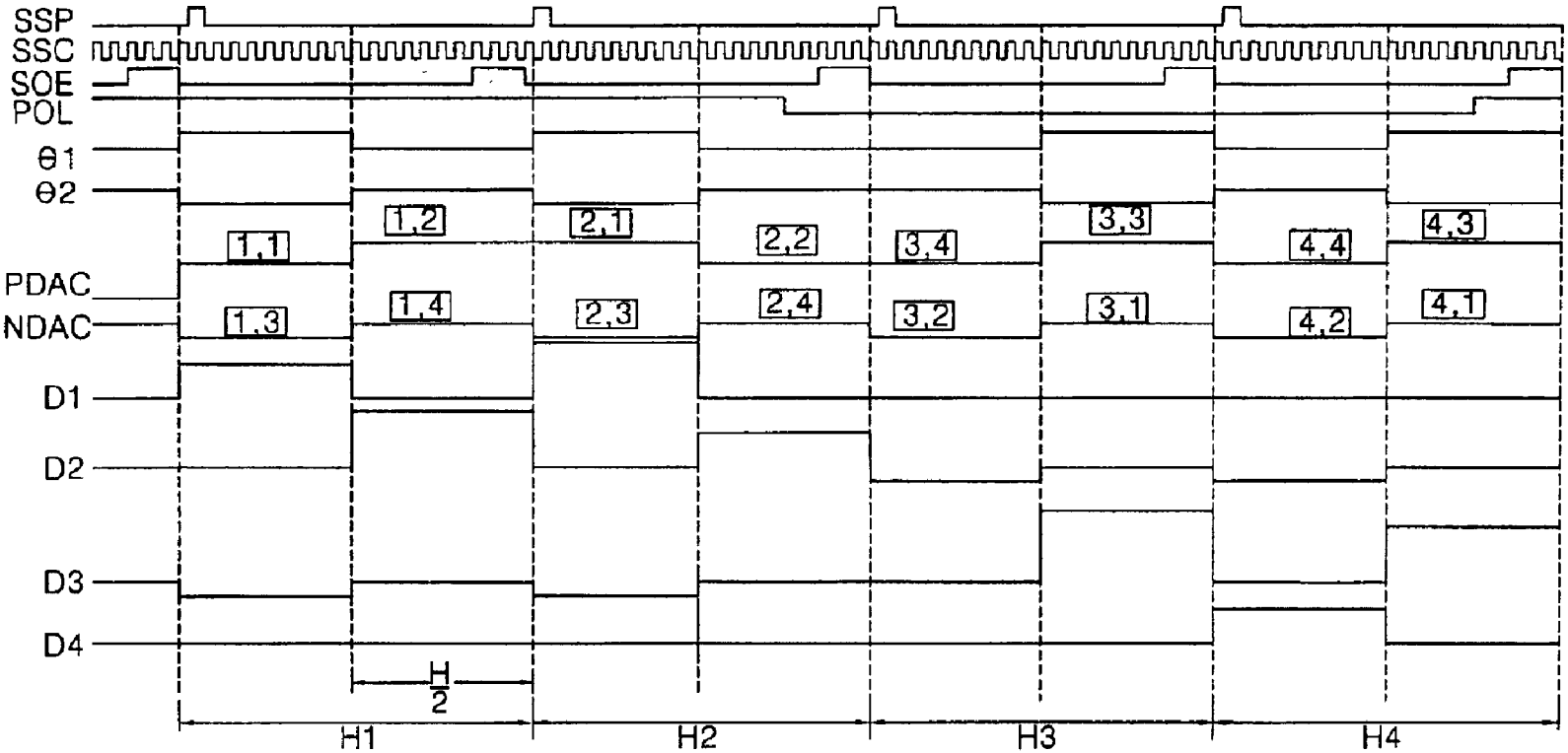
FIGS. 7A and 7B are another driving waveform diagrams of odd and even frames of the data-driving IC of FIG. 4.
Figure 7B:
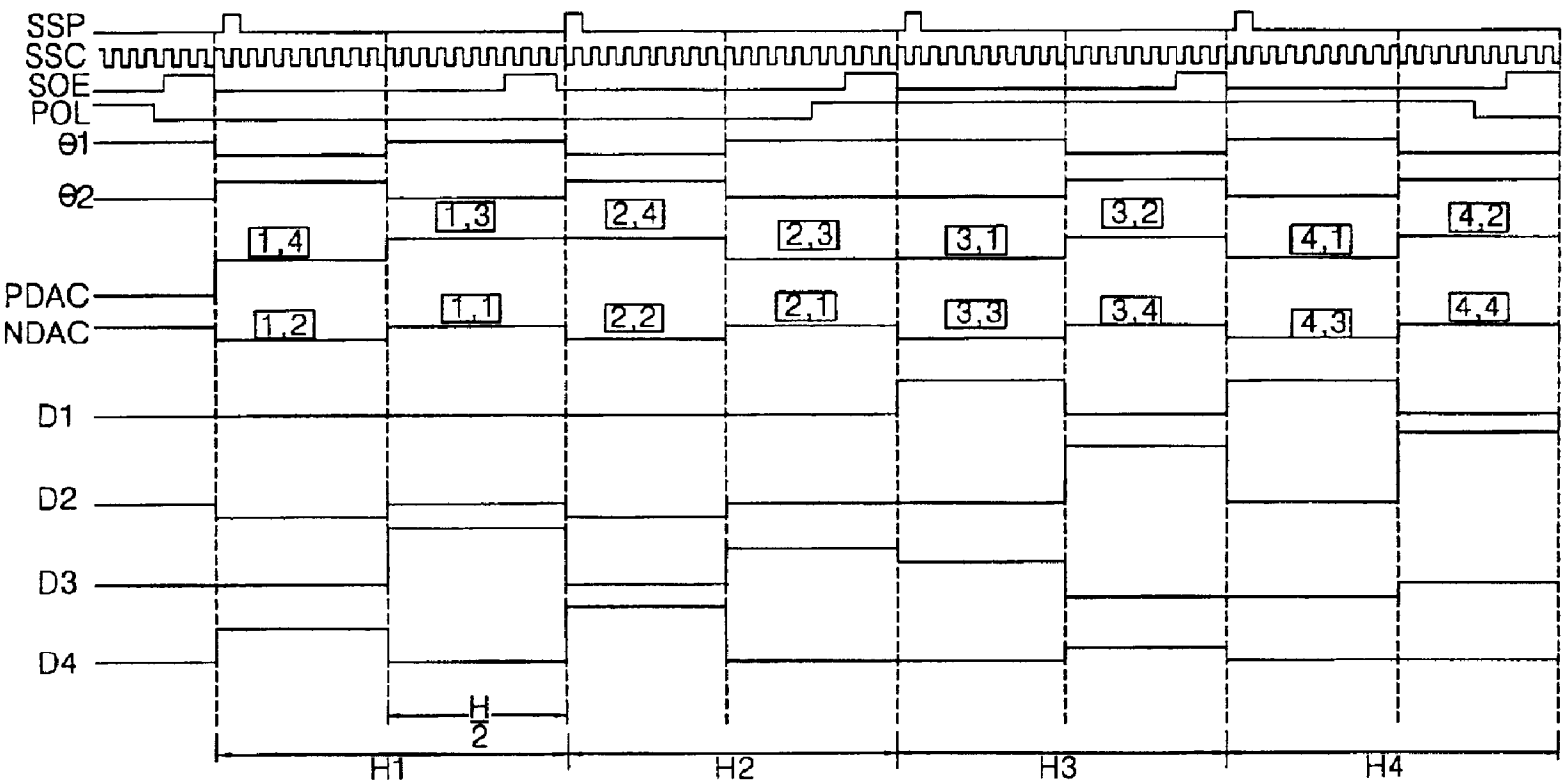
Figure 8A:
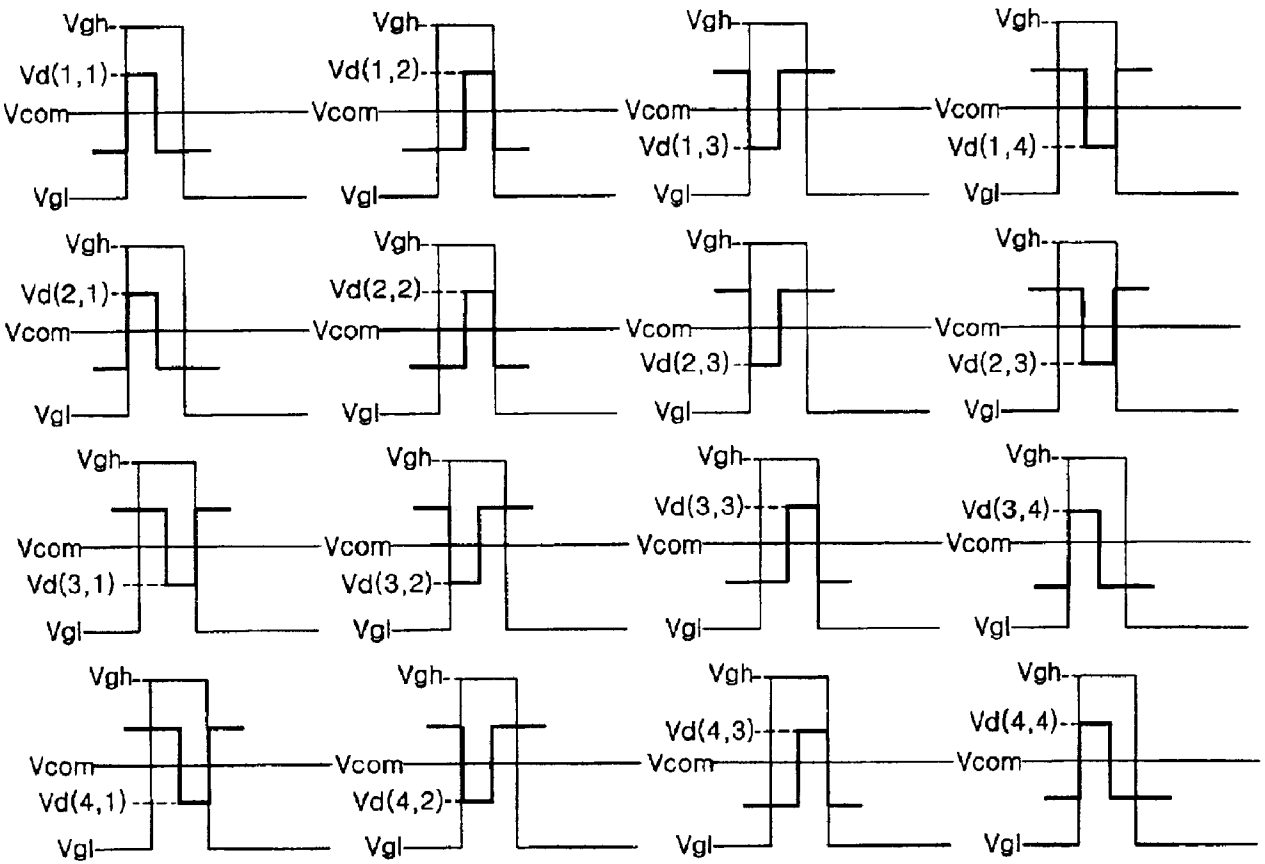
FIGS. 8A and 8B illustrate the charging characteristic of a liquid crystal cell by the driving waveform of FIGS. 7A and 7B.
Figure 8B:
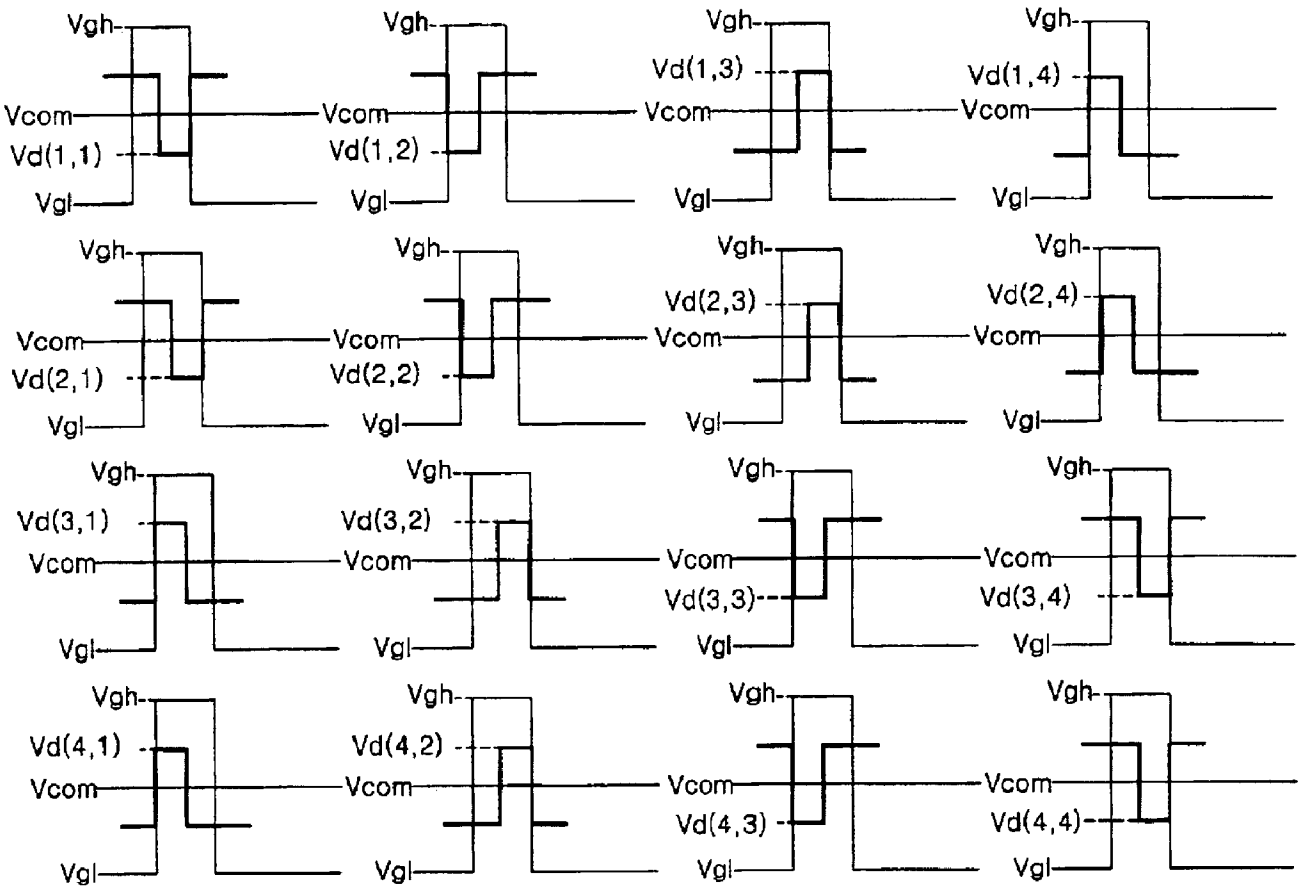

Differently, the data-driving IC, as shown in FIG. 4, can compensate the difference in the charging amount of the pixel voltage even when the charging sequence of the pixel signals is alternately changed for at least each two horizontal periods and each frame, as shown in FIGS. 7A and 7B. FIGS. 8A and 8B illustrate the charging characteristic of liquid crystal cells in accordance with the driving waveform shown in FIGS. 7A and 7B.

In FIG. 7A corresponding to the odd-frame, pixel data [1,1] and pixel data [1,3] are selected in response to the first and second selection signals θ1 and θ2, and converted into a positive pixel signal Vd[1,1] and a negative pixel signal Vd[1,3] in response to the polarity control signal POL, at the first half of the first horizontal period H1. And, pixel data [1,2] and pixel data [1,4] are selected in response to the first and second selection signals θ1 and θ2, the polarities of which are inverted, and converted into the positive pixel signal Vd[1,2] and the negative pixel signal Vd[1,4] in response to the polarity control signal POL, the polarity of which is retained, at the second half. Accordingly, as shown in FIG. 8A, each of liquid crystal cells [1,1] and [1,3] are charged with the positive pixel signal Vd[1,1] and the negative pixel signal Vd[1,3] at the first half of the first horizontal period H1, and each of liquid crystal cells [1,2] and [1,4] are charged with the positive pixel signal Vd[1,2] and the negative pixel signal Vd[1,4] at the second half.

Then, pixel data [2,2] and pixel data [2,4] are selected in response to the first and second selection signals θ1 and θ2, the polarities of which are retained, and converted into a positive pixel signal Vd[2,2] and a negative pixel signal Vd[2,4] in response to the polarity control signal POL, the polarity of which is retained, at the first half of the second horizontal period H2. And, pixel data [2,1] and pixel data [2,3] are selected in response to the first and second selection signals θ1 and θ2, the polarities of which are inverted, and converted into the positive pixel signal Vd[2,1] and the negative pixel signal Vd[2,3] in response to the polarity control signal POL, at the second half. Accordingly, as shown in FIG. 8A, each of liquid crystal cells [2,2] and [2,4] are charged with the positive pixel signal Vd[2,2] and the negative pixel signal Vd[2,4] at the first half of the second horizontal period H2, and each of liquid crystal cells [2,1] and [2,3] are charged with the positive pixel signal Vd[2,1] and the negative pixel signal Vd[2,3] at the second half.

Subsequently, pixel data [3,1] and pixel data [3,3] are selected in response to the first and second selection signals θ1 and θ2, the polarities of which are retained, and converted into a negative pixel signal Vd[3,1] and a positive pixel signal Vd[3,3] in response to the polarity control signal POL, the polarity of which is inverted, at the first half of the third horizontal period H3. And, pixel data [3,2] and pixel data [3,4] are selected in response to the first and second selection signals θ1 and θ2, the polarities of which are inverted, and converted into the negative pixel signal Vd[3,2] and the positive pixel signal Vd[3,4] in response to the polarity control signal POL, the polarity of which is retained, at the second half. Accordingly, as shown in FIG. 8A, each of liquid crystal cells [3,1] and [3,3] are charged with the negative pixel signal Vd[3,1] and the positive pixel signal Vd[3,3] at the first half of the third horizontal period H3, and each of liquid crystal cells [3,2] and [3,4] are charged with the negative pixel signal Vd[3,2] and the positive pixel signal Vd[3,4] at the second half.

Then, pixel data [4,2] and pixel data [4,4] are selected in response to the first and second selection signals θ1 and θ2, the polarities of which are retained, and converted into a negative pixel signal Vd[4,2] and a positive pixel signal Vd[4,4] in response to the polarity control signal POL, the polarity of which is retained, at the first half of the fourth horizontal period H4. And, pixel data [4,1] and pixel data [4,3] are selected in response to the first and second selection signals θ1 and θ2, the polarities of which are inverted, and converted into the negative pixel signal Vd[4,1] and the positive pixel signal Vd[4,3] in response to the polarity control signal POL, at the second half. Accordingly, as shown in FIG. 8A, each of liquid crystal cells [4,2] and [4,4] are charged with the negative pixel signal Vd[4,2] and the positive pixel signal Vd[4,4] at the first half of the fourth horizontal period H4, and each of liquid crystal cells [4,1] and [4,3] are charged with the negative pixel signal Vd[4,1] and the positive pixel signal Vd[4,3] at the second half.

In FIG. 7B corresponding to the even-frame, the pixel data [1,2] and the pixel data [1,4] are selected in response to the first and second selection signals θ1 and θ2, the polarities of which are inverted as compared with the odd-frame, and converted into the negative pixel signal Vd[1,2] and the positive pixel signal Vd[1,4] in response to the polarity control signal POL, the polarity of which is inverted as compared with the odd-frame, at the first half of the first horizontal period H1. And, the pixel data [1,1] and the pixel data [1,3] are selected in response to the first and second selection signals θ1 and θ2, the polarities of which are inverted, and converted into the negative pixel signal Vd[1,1] and the positive pixel signal Vd[1,3] in response to the polarity control signal POL, the polarity of which is retained, at the second half. Accordingly, as shown in FIG. 8B, each of liquid crystal cells [1,2] and [1,4] are charged with the negative pixel signal Vd[1,2] and the positive pixel signal Vd[1,4] at the first half of the first horizontal period H1, and each of liquid crystal cells [1,1] and [1,3] are charged with the negative pixel signal Vd[1,1] and the positive pixel signal Vd[1,3] at the second half.

Then, the pixel data [2,1] and the pixel data [2,3] are selected in response to the first and second selection signals θ1 and θ2, the polarities of which are retained, and converted into the negative pixel signal Vd[2,1] and the positive pixel signal Vd[2,3] in response to the polarity control signal POL, the polarity of which is retained, at the first half of the second horizontal period H2. And, the pixel data [2,2] and the pixel data [2,4] are selected in response to the first and second selection signals θ1 and θ2, the polarities of which are inverted, and converted into the negative pixel signal Vd[2,2] and the positive pixel signal Vd[2,4] in response to the polarity control signal POL, the polarity of which is retained, at the second half. Accordingly, as shown in FIG. 8B, each of liquid crystal cells [2,1] and [2,3] are charged with the negative pixel signal Vd[2,1] and the positive pixel signal Vd[2,3] at the first half of the second horizontal period H2, and each of liquid crystal cells [2,2] and [2,4] are charged with the negative pixel signal Vd[2,2] and the positive pixel signal Vd[2,4] at the second half.

Subsequently, the pixel data [3,2] and the pixel data [3,4] are selected in response to the first and second selection signals θ1 and θ2, the polarities of which are retained, and converted into the positive pixel signal Vd[3,2] and the negative pixel signal Vd[3,4] in response to the polarity control signal POL, the polarity of which is inverted, at the first half of the third horizontal period H3. And, the pixel data [3,1] and the pixel data [3,3] are selected in response to the first and second selection signals θ1 and θ2, the polarities of which are inverted, and converted into the positive pixel signal Vd[3,1] and the negative pixel signal Vd[3,3] in response to the polarity control signal POL, the polarity of which is retained, at the second half. Accordingly, as shown in FIG. 8B, each of liquid crystal cells [3,2] and [3,4] are charged with the positive pixel signal Vd[3,2] and the negative pixel signal Vd[3,4] at the first half of the third horizontal period H3, and each of liquid crystal cells [3,1] and [3,3] are charged with the positive pixel signal Vd[3,1] and the negative pixel signal Vd[3,3] at the second half.

Then, the pixel data [4,1] and the pixel data [4,3] are selected in response to the first and second selection signals θ1 and θ2, the polarities of which are retained, and converted into the positive pixel signal Vd[4,1] and the negative pixel signal Vd[4,3] in response to the polarity control signal POL, the polarity of which is retained, at the first half of the fourth horizontal period H4. And, the pixel data [4,2] and the pixel data [4,4] are selected in response to the first and second selection signals θ1 and θ2, the polarities of which are inverted, and converted into the positive pixel signal Vd[4,2] and the negative pixel signal Vd[4,4] in response to the polarity control signal POL, at the second half. Accordingly, as shown in FIG. 8B, each of liquid crystal cells [4,1] and [4,3] are charged with the positive pixel signal Vd[4,1] and the negative pixel signal Vd[4,3] at the first half of the fourth horizontal period H4, and each of liquid crystal cells [4,2] and [4,4] are charged with the positive pixel signal Vd[4,2] and the negative pixel signal Vd[4,4] at the second half.

In this way, the driving apparatus of the present invention drives the data lines on a time-division basis by the vertical horizontal two-dot inversion scheme and alternately changes the charging sequence of the pixel voltage for each two horizontal periods and each frame for driving.

Specifically, the data-driving IC according to the present invention has the polarity of the pixel signal inverted for each two data lines and is driven by a vertical horizontal two-dot inversion scheme in which the pixel voltage of the data lines has the polarity inverted for each two horizontal periods. This is because vertical cross-talks occur in specific patterns such as window shut pattern, as shown in FIGS. 9A to 10B, when the data lines are driven on the time-division basis by the horizontal two-dot inversion scheme, thereby deteriorating the picture quality of an image.

Figure 9A:
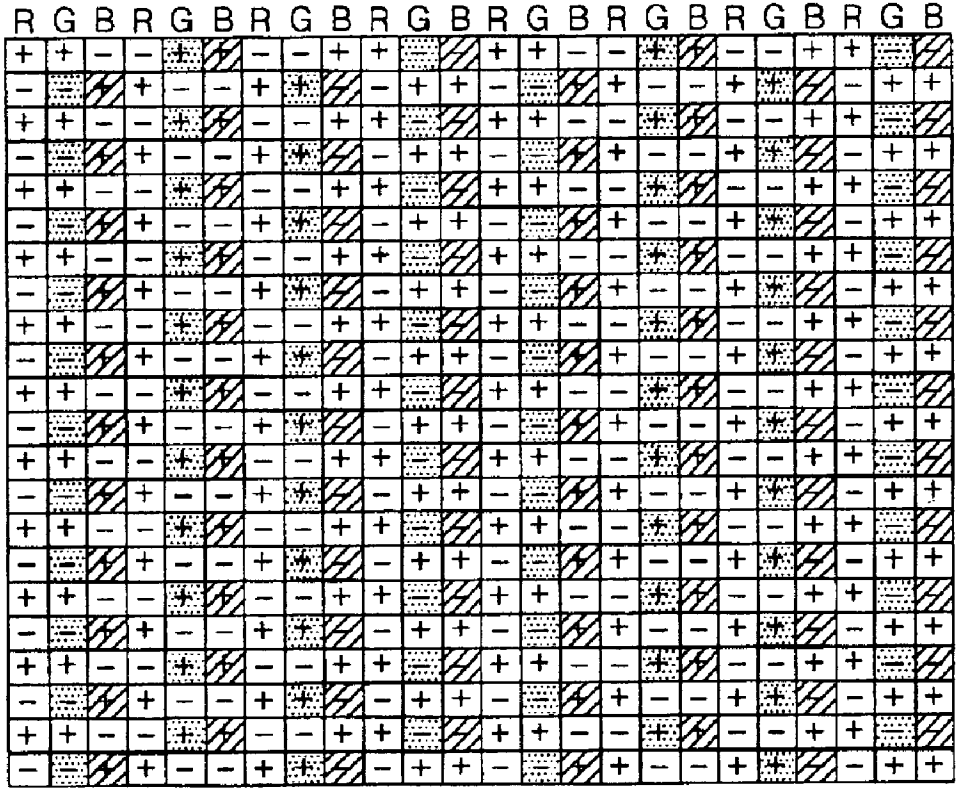
FIGS. 9A and 9B illustrate odd and even frames of a window shut cyan pattern driven by a horizontal two-dot inversion scheme.
Figure 9B:
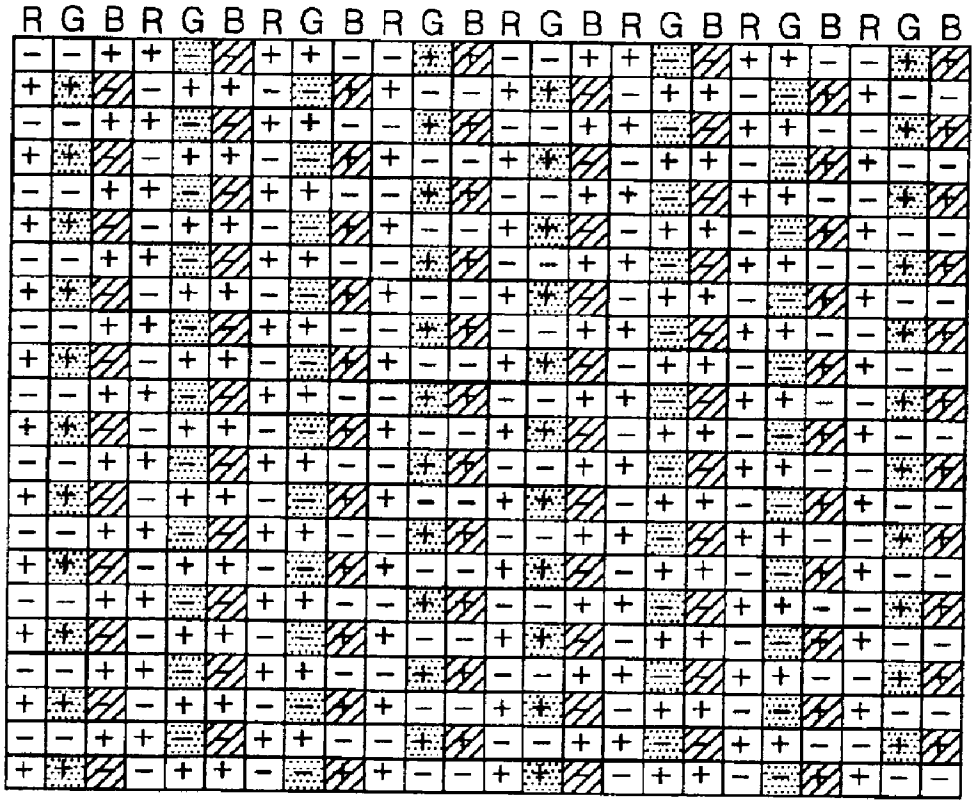

FIGS. 9A and 9B illustrate a cyan dot pattern which is a window shut pattern displayed in a liquid crystal display panel driven by a horizontal two-dot inversion scheme in an odd-numbered frame and an even-numbered frame.

Referring to FIGS. 9A and 9B, green and blue liquid crystal cells G and B emitting light are alternately arranged along a horizontal line to display the cyan dot pattern in the shut mode. The green liquid crystal cells G emitting light in each of an odd-numbered frame shown in FIG. 10A and an even-numbered frame shown in FIG. 10B are charged in turn with the positive pixel voltage (+) and the negative pixel voltage (−) for each vertical line. Accordingly, between the vertical line charged with the positive pixel voltage (+) and the vertical line charged with the negative pixel voltage (−), a difference in capacitor coupling amount and a difference in each ΔVp of the positive and negative pixel voltages occur, so as to cause cross-talks. In this case, there occur more intensive cross-talks as compared to when displaying the cyan dot pattern.

In such a horizontal two-dot inversion scheme, the vertical cross-talk phenomenon caused by the ΔVp difference and the difference in the capacitor coupling amount becomes more intensive when the data lines are time-divided, and there occurs the difference of charging amount caused by the difference of charging time between the liquid crystal cells.

Figure 11A:
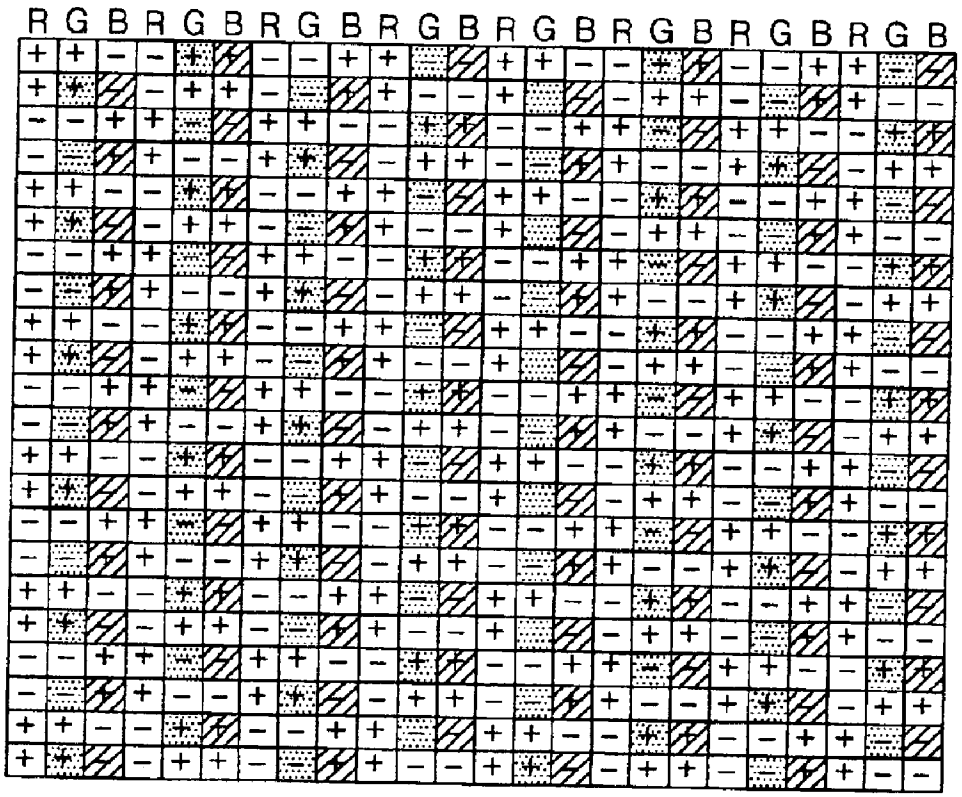
FIGS. 11A and 11B illustrate odd and even frames of a window shut cyan pattern driven by a vertical-horizontal two-dot inversion scheme according to the present invention.
Figure 11B:
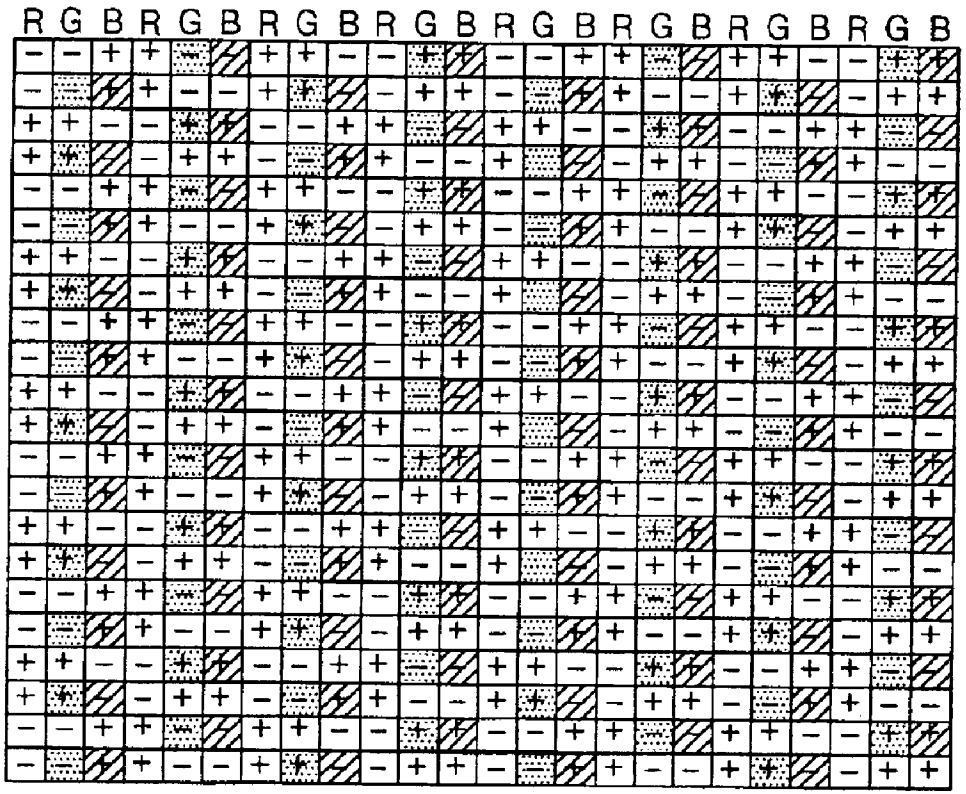

FIGS. 11A and 11B illustrate a cyan dot pattern which is a window shut pattern displayed in a liquid crystal display panel driven by a vertical horizontal two-dot inversion scheme in an odd-numbered frame and an even-numbered frame according to the present invention. window shut mode. The green-liquid crystal cells G emitting light in each of an odd-numbered frame shown in FIG. 9A and an even-numbered frame shown in FIG. 9B are charged in turn with the positive pixel voltage (+) and the negative pixel voltage (−) for each vertical line. Further, the blue liquid crystal cells B emitting light in the odd-numbered frame are charged in turn with the positive pixel voltage (+) and the negative pixel voltage (−) for each vertical line. Accordingly, between the vertical line charged with the positive pixel voltage (+) and the vertical line charged with the negative pixel voltage (−), a difference in capacitor coupling amount and a difference in each ΔVp of the positive and negative pixel voltages occur, thereby causing cross-talks. In this case, the green liquid crystal cell G and the blue liquid crystal cell B, which are adjacent to one another, have polarities opposite to each other, thus the ΔVp difference is gradually set-off, however, cross-talks still occur.

Figure 10A:
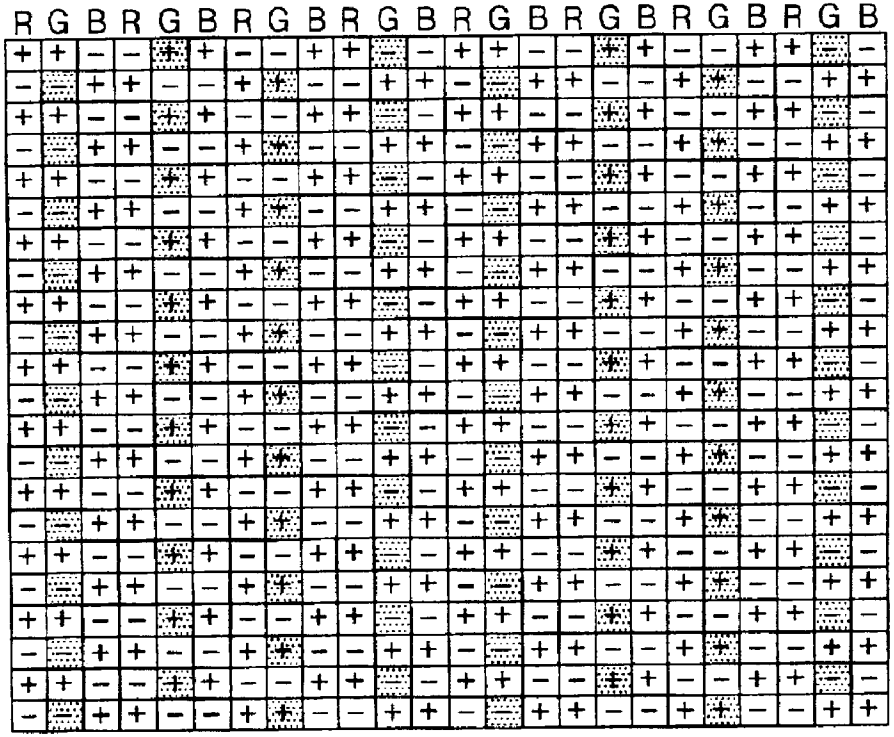
FIGS. 10A and 10B illustrate odd and even frames of a window shut green pattern driven by a horizontal two-dot inversion scheme.
Figure 10B:
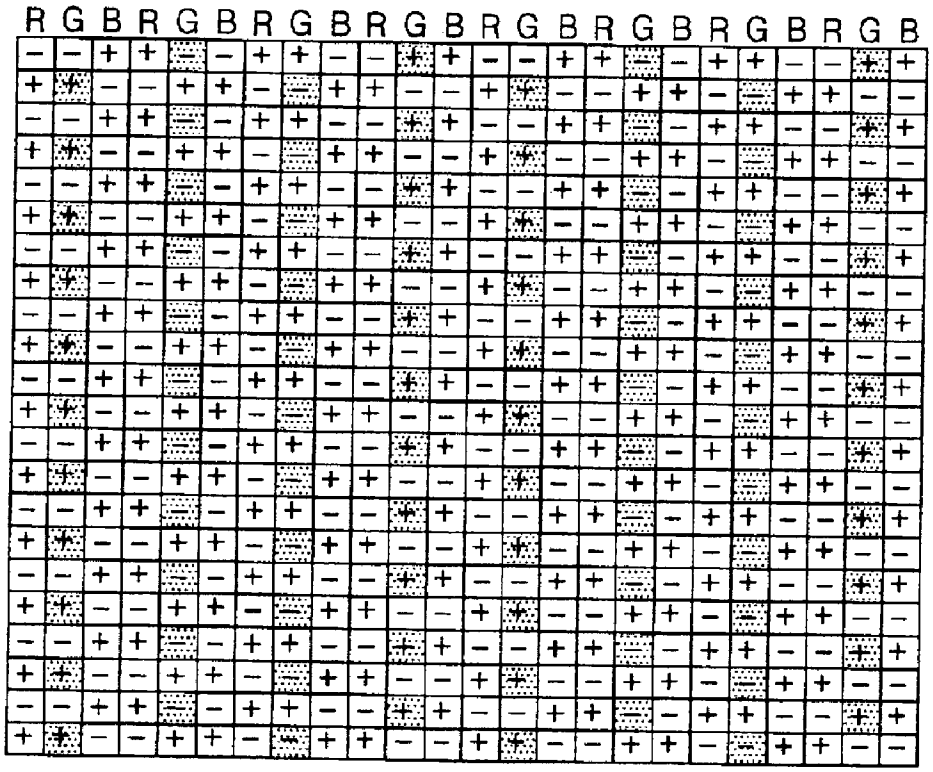

FIGS. 10A and 10B illustrate a green dot pattern which is a window shut pattern displayed in a liquid crystal display panel driven by a horizontal two-dot inversion scheme in an odd-numbered frame and an even-numbered frame.

Referring to FIGS. 10A and 10B, green liquid crystal cells G emitting light are alternately arranged along a horizontal line to display the green dot pattern in the window Referring to FIGS. 11A and 11B, green and blue liquid crystal cells G and B emitting light are alternately arranged along a horizontal line to display the cyan dot pattern in the window shut mode. The green liquid crystal cells G emitting light in each of an odd-numbered frame shown in FIG. 11A and an even-numbered frame shown in FIG. 11B are charged with both the positive pixel voltage (+) and the negative pixel voltage (−) in each vertical line. Further, the blue liquid crystal cells B emitting light in the odd-numbered frame are charged with both the positive pixel voltage (+) and the negative pixel voltage (−) in each vertical line. Accordingly, the liquid crystal cells charged with the positive pixel voltage (+) and the liquid crystal cells charged with the negative pixel voltage (−) are mixed together in each vertical line. Thus, a difference in capacitor coupling amount and a difference in each ΔVp of the positive and negative pixel voltages are set-off, thereby preventing the cross-talks between the vertical lines.

Figure 12A:
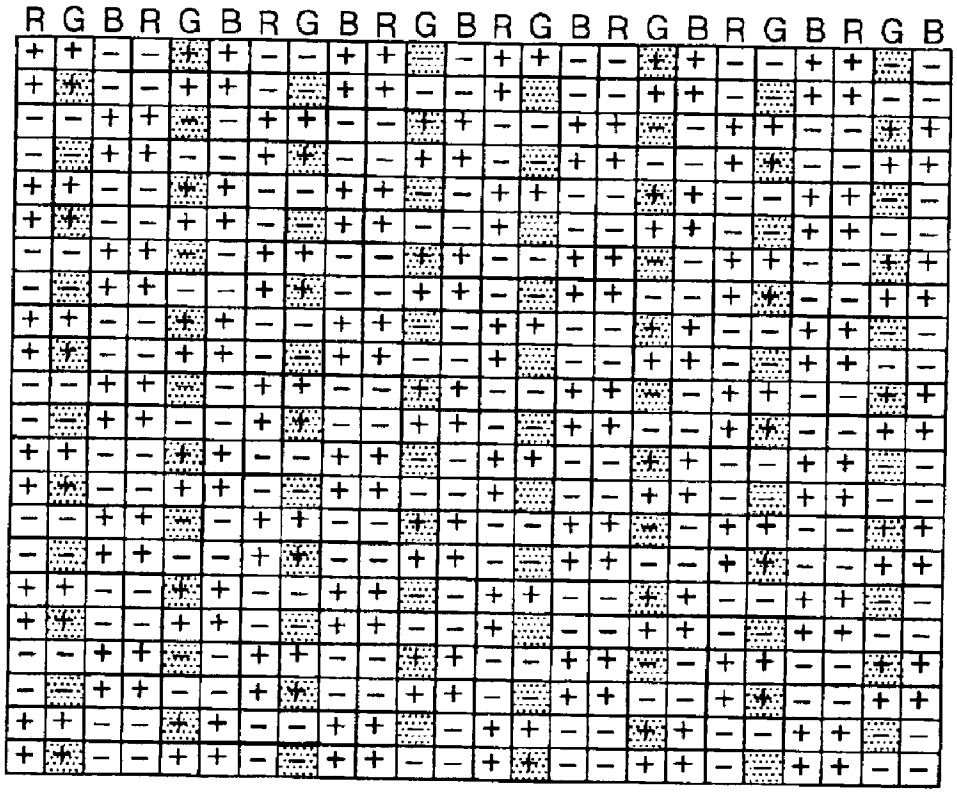
FIGS. 12A and 12B illustrate odd and even frames of a window shut green pattern driven by a vertical-horizontal two-dot inversion scheme according to the present invention.
Figure 12B:
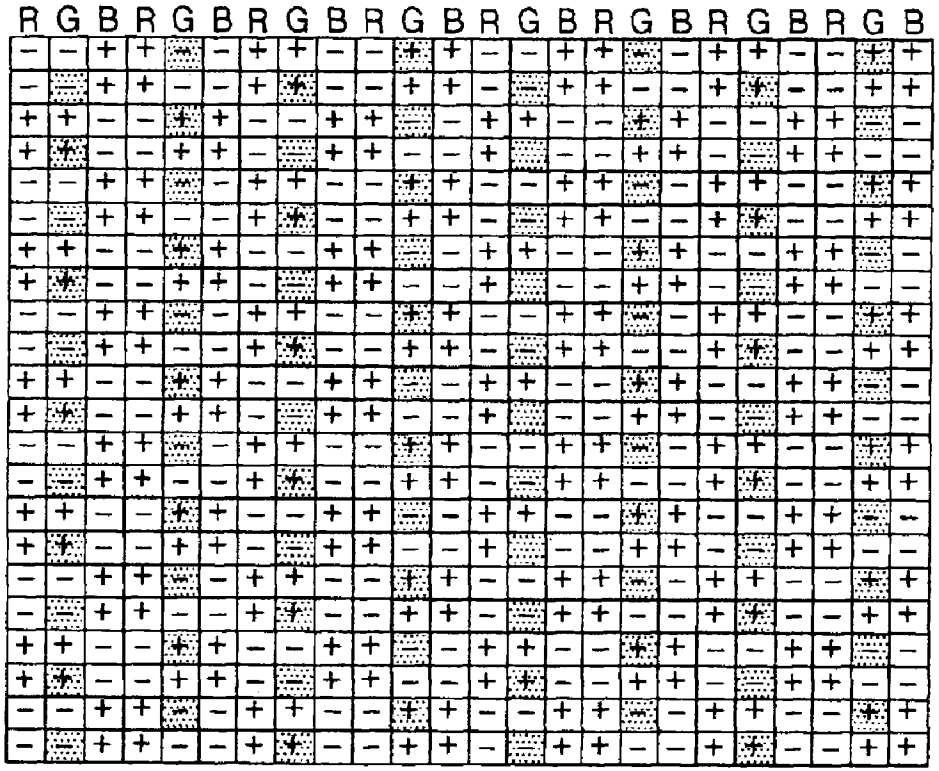

FIGS. 12A and 12B illustrate a green dot pattern which is a window shut pattern displayed in a liquid crystal display panel driven by a vertical horizontal two-dot inversion scheme in an odd-numbered frame and an even-numbered frame.

Referring to FIGS. 12A and 12B, green liquid crystal cells G emitting light are alternately arranged along a horizontal line to display the green dot pattern in the window shut mode. The green liquid crystal cells G emitting light in each of an odd-numbered frame shown in FIG. 12A and an even-numbered frame shown in FIG. 12B are charged with both the positive pixel voltage (+) and the negative pixel voltage (−) in each vertical line. Accordingly, the liquid crystal cells charged with the positive pixel voltage (+) and the liquid crystal cells charged with the negative pixel voltage (−) are mixed together in each vertical line. Thus, a difference in capacitor coupling amount and a difference in each ΔVp of the positive and negative pixel voltages are set-off, thereby preventing the cross-talks between the vertical lines.

Figure 13:
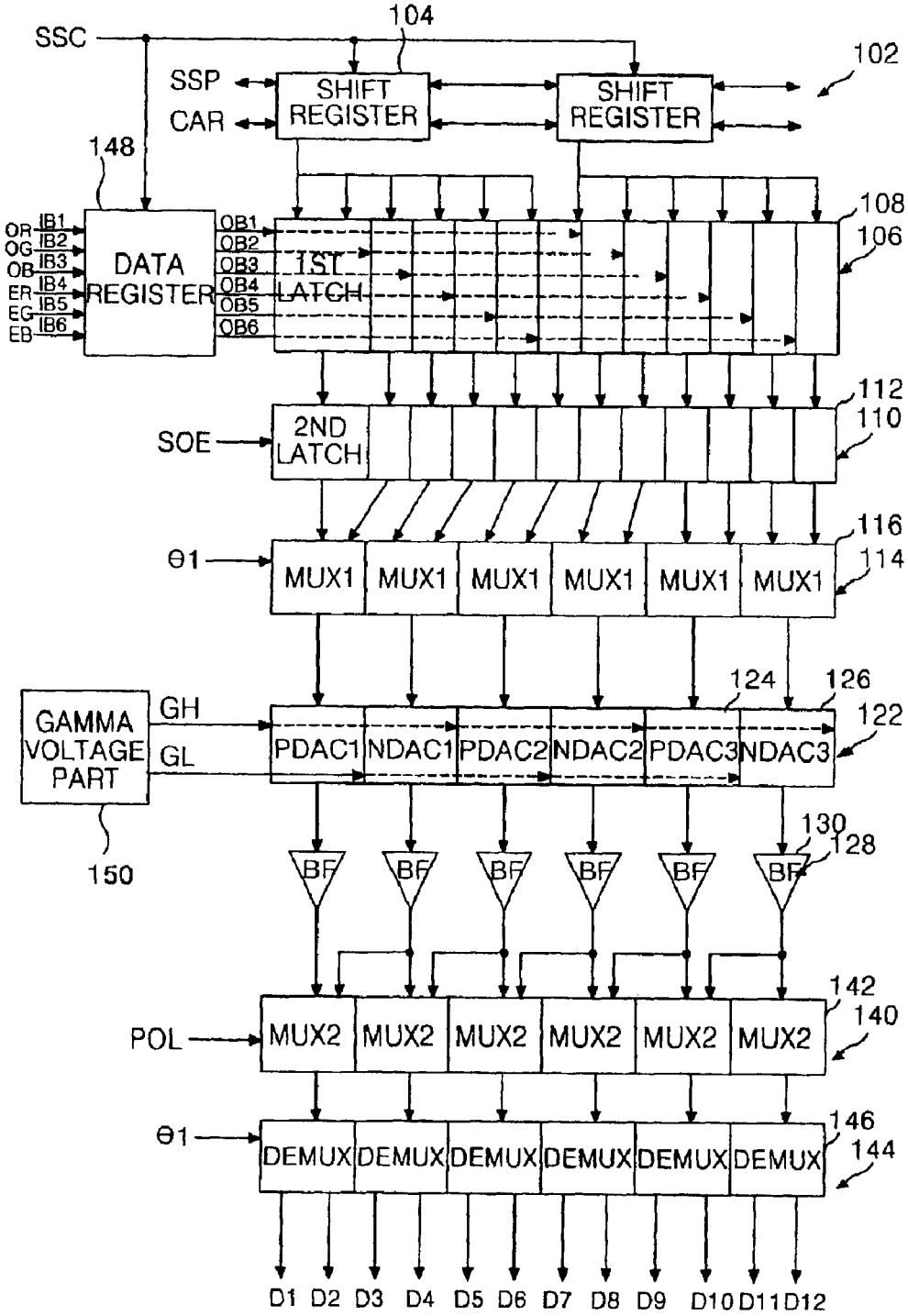
FIG. 13 is a detailed block diagram showing a configuration of a data-driving IC according to a second embodiment of the present invention.
Figure 14A:
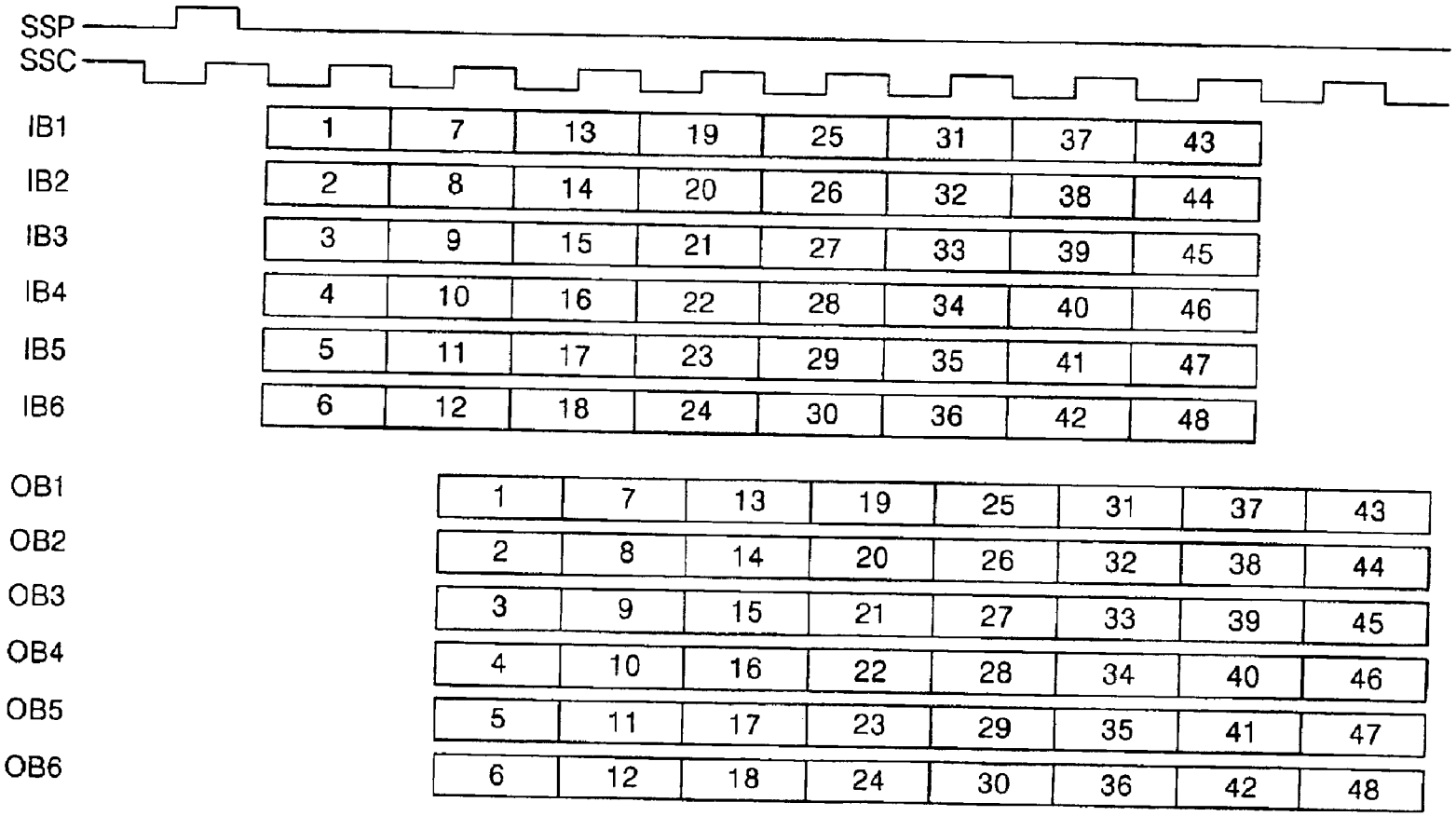
FIGS. 14A and 14B are driving waveform diagrams of the data register of FIG. 13.
Figure 14B:
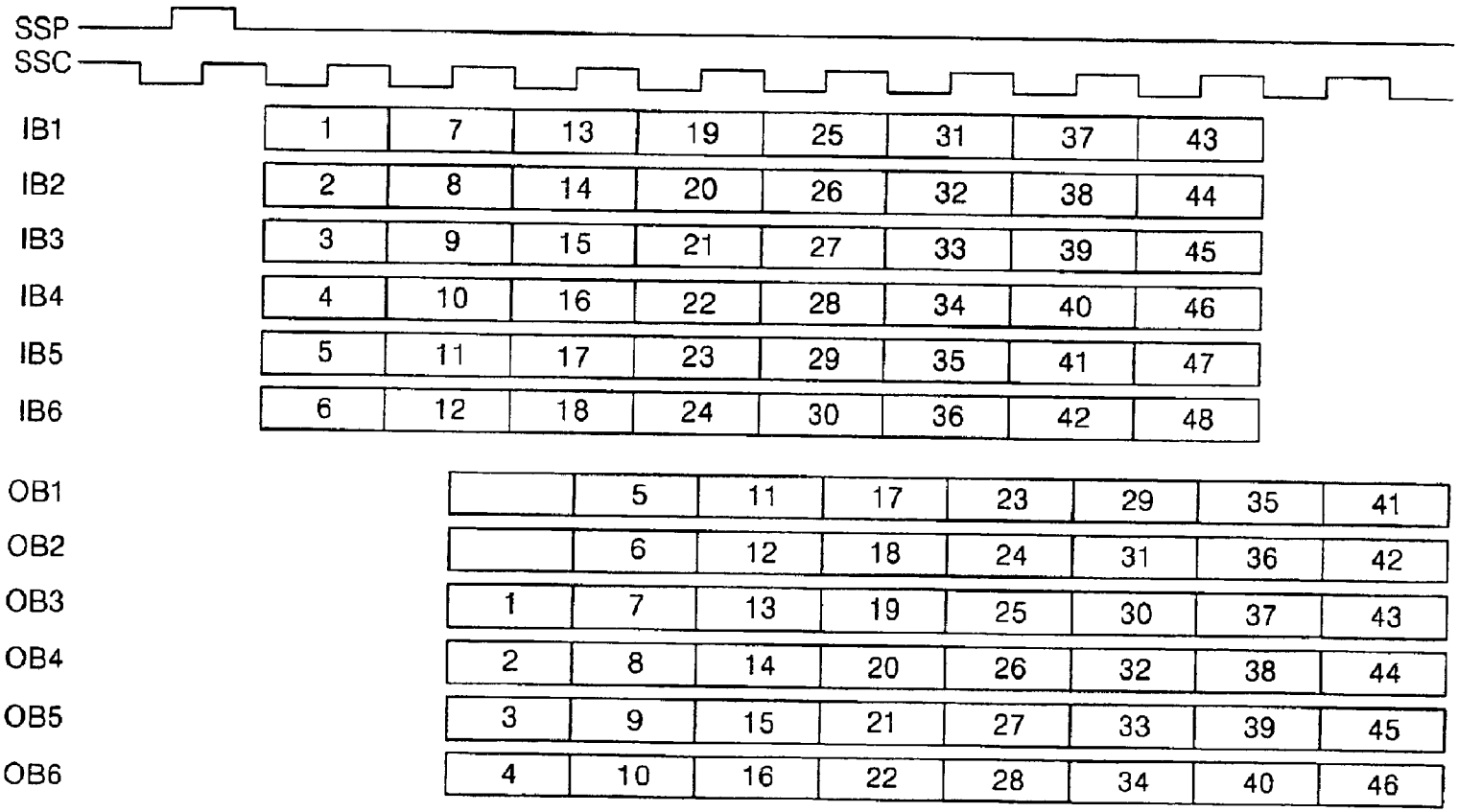
Figure 15A:
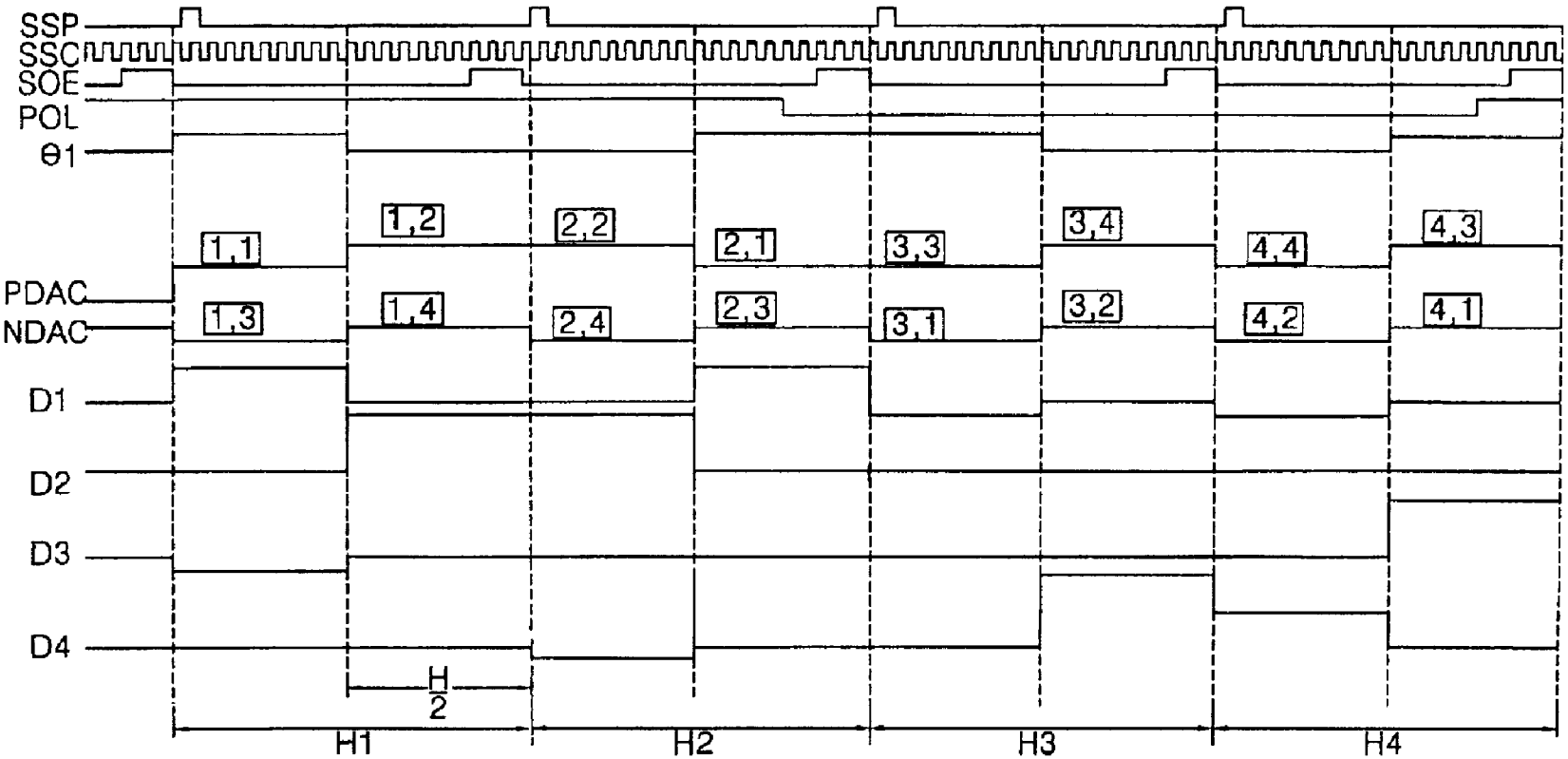
FIGS. 15A and 15B are driving waveform diagrams of odd and even frames of the data-driving IC of FIG. 13.
Figure 15B:
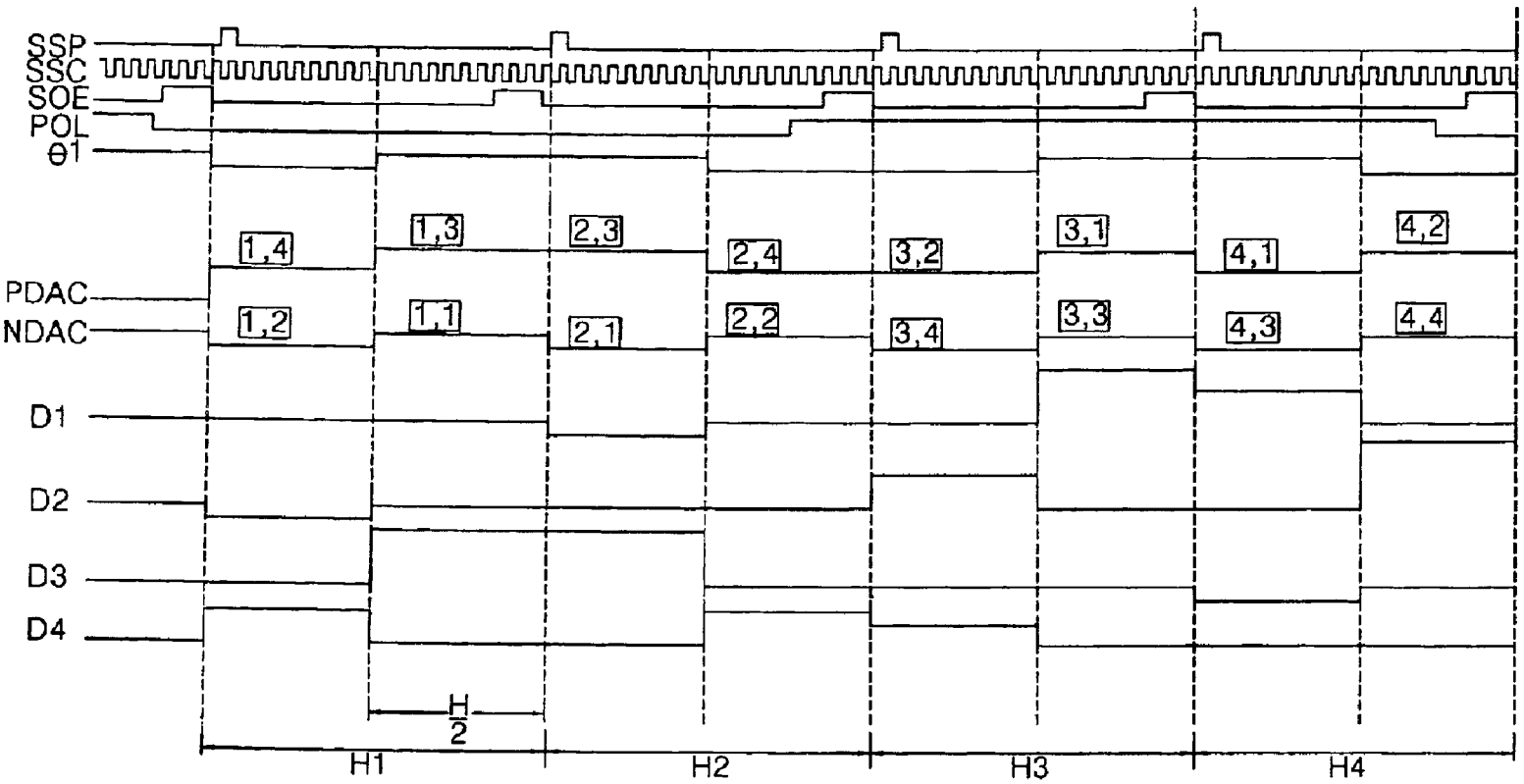

FIG. 13 is a detailed block diagram of a configuration of a data-driving IC of a liquid crystal display device according to a second embodiment of the present invention. FIGS. 15A and 15B are driving waveform diagrams of odd and even frames of the data-driving IC shown in FIG. 13. And, FIGS. 14A and 14B are driving waveform diagrams of the data register 148, shown in FIG. 13, during the $(m-2)^{th}$ and $(m-1)^{th}$ horizontal periods and the $m^{th}$ and $(m+1)^{th}$ horizontal periods.

The data-driving IC, as illustrated in FIG. 13, includes a shift register array 102 for applying a sequential sampling signal, first and second latch arrays 106 and 110 for latching and outputting pixel data R, G, and B in response to the sampling signal, a MUX1 array 114 for performing a time-division on the pixel data R, G, and B from the second latch array 110 and outputting the time-divided pixel data, a digital-to-analog converter (DAC) array 122 for converting the pixel data R, G, and B from the MUX1 array 114 into pixel signals, a buffer array 128 for buffering and outputting the pixel signals from the DAC array 122, a MUX2 array 140 for controlling a path of an output of the buffer array 128, and a DEMUX array 144 for performing a time-division on the pixel signals from the MUX2 array 140 to output the time-divided signals to data lines D1 to D2*n* .

Further, the data-driving IC, illustrated in FIG. 13, includes a data register 148 for rearranging and outputting pixel data R, G, and B from a timing controller (not shown), and a gamma voltage part 150 for supplying positive and negative gamma voltages required in the DAC array 122.

Each data-driving IC having the above-described configuration performs a time-divisional driving of the DAC array 122 using the MUX1 array 114 and the DEMUX array 144, thereby driving 2n data lines, which are twice the data lines of the related art, using (n+2) DAC's 124 and 126 and buffers 130. The present data-driving IC has 2n channel data outputs so as to drive 2n data lines. However, FIG. 13 illustrates only 12 channels D1 to D12 of the 2n channels of the data-driving IC when n is 6, for example. And, the data-driving IC alternately changes the charging sequence of the pixel signals for at least each horizontal period 1H and each frame, and at the same time, drives the data lines by the vertical horizontal two-dot inversion scheme, thereby improving the picture quality of an image.

The gamma voltage part 150 further divides a plurality of gamma reference voltages inputted from a gamma reference voltage generator (not shown) by gray levels to output.

The data register 148 appropriately rearranges the pixel data from the timing controller for a vertical horizontal two-dot inversion driving to apply the rearranged pixel data to the first latch array 106. The data register 148 receives the odd pixel data OR, OG, and OB and the even pixel data ER, EG, and EB from the timing controller through the first to the sixth input bus IB1 to IB6, simultaneously. And, the data register 148 latches the odd pixel data OR, OG, and OB and the even pixel data ER, EG, and EB inputted for each two horizontal periods and outputs the latched pixel data through the first to the sixth output buses OB1 to OB6 while retaining the channel intact, or after shifting the latched pixel data. In this way, since the pixel data OR, OG, OB, ER, EG, and EB inputted from the data register 148 are outputted while the output channel is alternately changed for each two horizontal period, it can be possible to remove the multiplexer array determining the progress path of the pixel data in accordance with the polarity control signal POL between the MUX1 array 114 and the digital-to-analog converter array 122.

More specifically, the data register 148, as shown in FIGS. 14A and 14B, receives the six pixel data OR, OG, OB, ER, EG, and EB through the first to the sixth input buses,IB1 to IB6, respectively. In this case, the data register 148 receives six pixel data OR, OG, OB, ER, EG, and EB for each period of shift clock signal SSC on the basis of the source start pulse SSP.

And the data register 148, as shown in FIG. 14A, latches the pixel data OR, OG, OB, ER, EG, and EB inputted by set of six data and outputs the latched pixel data through each of the first to sixth output bus OB1 to OB6 while retaining the channel intact, in $(m-2)^{th}$ and $(m-1)^{th}$ horizontal periods.

Also, in the $m^{th}$ and $(m+1)^{th}$ horizontal period, the data register 148, as shown in FIG. 14B, latches the pixel data OR, OG, OB, ER, EG, and ED inputted by a set of six and outputs the latched pixel data through each of the first to sixth output bus OB1 to OB6 after delaying (i.e., shifting) the latched pixel data by two channels. For instance, the data register 148 shifts the first pixel data to the third output bus OB3, the second pixel data to the fourth output bus OB4, the third pixel data to the fifth output bus OB5, and the fourth pixel data to the sixth output bus OB6, then outputs the shifted pixel data. And, in the next clock, the fifth pixel data is shifted to the first output bus OB1, the sixth pixel data to the second output bus OB2, and the seventh pixel data to the third output bus OB3, then they are outputted.

In this way, the pixel data ORO, OGO, OBO, ERO, EGO, and EBO rearranged to be outputted at the data register 148 are delayed for a specific time compared to the inputted pixel data OR, OG, OB, ER, EG, and ED in order to secure time for rearrangement, then they are outputted. In other words, they are delayed by about ⅔ clock and outputted.

Figure 16A:
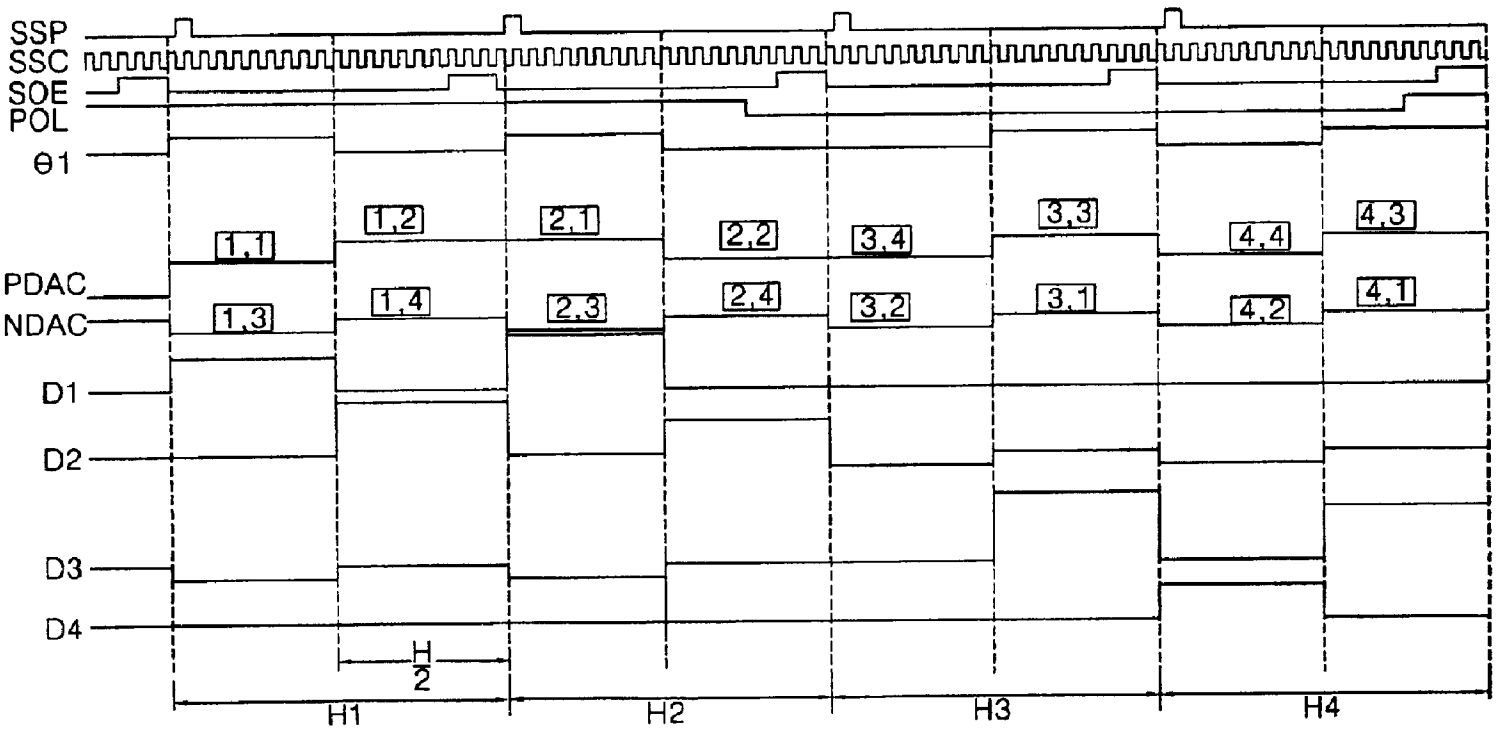
FIGS. 16A and 16B are another driving waveform diagrams of odd and even frames of the data-driving IC of FIG. 13.
Figure 16B:
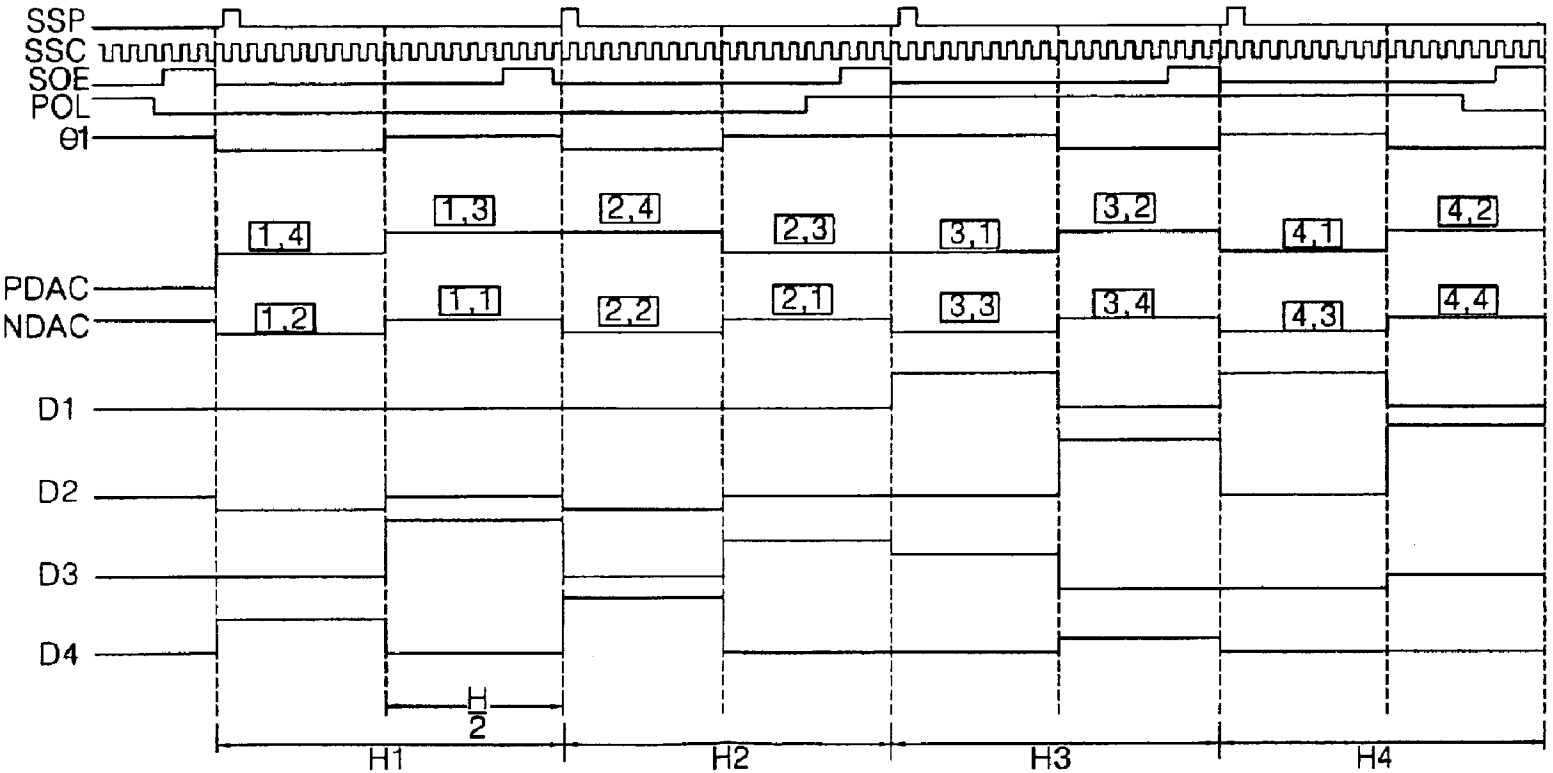

The shift register array 102 generates and applies sequential sampling signals to the first latch array 106. To this end, the shift register array 102 is comprised of 2n /6 (herein, for example, n=6) shift registers 104. The shift register 104 at the first stage of FIG. 13 shifts a source start pulse SSP from the timing controller in response to a source sampling clock signal SSC and outputs the shifted source start pulse as a sampling signal, and at the same time applies to the shift register 104 at the next stage as a carry signal CAR. The source start pulse SSP is applied for each horizontal period, as shown in FIGS. 16A and 16B, and is shifted for each source sampling clock signal SSC to be outputted as a sampling signal.

The first latch array 106 samples a set of the six pixel data inputted from the data register 148 through the first to the sixth output buses OB1 to OB6 in response to the sampling signal from the shift register array 102 and latches the sampled pixel data. The first latch array 106 consists of 2n first latches 108 for latching 2n (herein, n=6) pixel data R, G, and B, each of which has a size corresponding to the bit number (i.e., 6 bits or 8 bits) of the pixel data R, G, and B. Also, the first latch array 106, as shown in FIG. 14B, includes two first latches (not shown) in case it is inputted by being shifted by two channels.

For example, the pixel data are latched in the order of 1, 2, 3, 4, 5, 6, 7, 8, 9, 10, 11, 12, which are outputted from the data register 148, at the $1^{st}$ first latch 108 to the $12^{th}$ first latch 108, in the $(m-2)^{th}$ and $(m-1)^{th}$ horizontal periods. And, in the $m^{th}$ and $(m+1)^{th}$ horizontal periods, the pixel data from the data register 148 are shifted by two channels and outputted, so that blank data are inputted to the $1^{st}$ first latch 108 and the $2^{nd}$ first latch 108, the pixel data are latched in the order of 1, 2, 3, 4, 5, 6, 7, 8, 9, 10 shifted by two channels at the $3^{rd}$ first latch 108 to the $12^{th}$ first latch 108. Herein, the eleventh and the twelfth pixel data are latched at two latches (not shown).

The MUX1 array 114 performs an n time-division on 2n (herein, for example, n=2) pixel data from the second latch array 110 for each H/2 period to output the time-divided pixel data in response to a selection control signal θ1 from the timing controller. In this case, the first MUX array 114 alternately changes the sequence of the pixel data, which are outputted for each H/2 period, for at least each horizontal and each frame. To this end, the MUX1 array 114 consists of n MUX1s 116. Also, the MUX1 array 114 has an additional MUX1 (not shown) considering that the pixel data is shifted by two channels. Each of the MUX1s 116 selects and outputs any one output of the two adjacent second latches 112 in the second latch array 110. In other words, each of the MUX1s 116 performs a time-division on the outputs of the two adjacent second latches 112 for each ½ period to apply the time-divided output.

More specifically, for a vertical horizontal two-dot inversion driving, the odd-numbered MUX1 116 performs a time-division on the output signals of two adjacent second latches 112 in response to the selection control signal θ1 and outputs the time-divided signals to the PDAC 124 of the DAC array 122. Conversely, the even-numbered MUX1 116 performs a time-division on the output signals of two adjacent second latches 112 in response to the selection control signal θ1 and outputs the time-divided signals to the NDAC1 126 of the DAC array 122. And, each of the MUX1s 116 alternately changes the output selection sequence of the second latches 112 for at least each horizontal period and each frame. To this end, the polarity of the selection control signal θ1 is inverted for each horizontal period, as shown in FIGS. 15A and 15B.

For example, the first MUX1 116 responds to the selection control signal θ1, in the $(m-2)^{th}$ and $(m-1)^{th}$ horizontal periods, to select a first pixel data from the $1^{st}$ second latch 112 at the first half and a second pixel data from the $2^{nd}$ second latch 112 at the second half, and then to output the selected data to PDAC1 124. At the same time, the second MUX1 116 responds to the selection control signal θ1 to select a third pixel data from the $3^{rd}$ second latch 112 at the first half and a fourth pixel data from the $4^{th}$ second latch 112 at the second half, and then to output the selected data to NDAC1 126.

And then, in the $m^{th}$ and $(m+1)^{th}$ horizontal periods when the pixel data are shifted by two channels and latched, the second MUX1 116, having the output sequence of the pixel data changed again in accordance with the selection control signal θ1, selects the second pixel data from the $4^{th}$ second latch 112 at the first half and the first pixel data from the $3^{rd}$ second latch 112 at the second half, and then outputs the selected data to NDAC1 126. And at the same time, the third MUX1 116 responds to the selection control signal θ1 to select the fourth pixel data from the $6^{th}$ second latch 112 at the first half and the third pixel data from the $5^{th}$ second latch 112 at the second half, and then to output the selected data to PDAC1 124.

And, in the next frame, the driving method of the $(m-2)^{th}$ and $(m-1)^{th}$ horizontal periods is exchanged with the driving method of the $m^{th}$ and $(m+1)^{th}$ horizontal periods, and the MUX1 array 114 uses the exchanged driving method.

The DAC array 122 converts the pixel data from the MUX1 array 114 into pixel signals by using positive and negative gamma voltages GH and GL from the gamma voltage part 150 to output the pixel signals. To this end, the DAC array 122 includes (n+1) PDAC's 124 and (n+1) NDAC's 126, which are alternately arranged. The PDAC 124 converts the pixel data from the MUX1 array 114 into positive pixel signals using the positive gamma voltages GH. On the other hand, the NDAC 126 converts the pixel data R, G, and B from the MUX1 array 114 into negative pixel signals using the negative gamma voltages GL. Such PDAC 124 and NDAC 126 carry out an operation of converting the digital pixel data inputted for each ½ horizontal period into analog pixel signals.

For instance, the PDAC1 124 converts the first and third pixel data inputted time-divisionally in each of the $(m-2)^{th}$ and $(m-1)^{th}$ horizontal periods into positive pixel signals, as shown in FIGS. 15A and 15B, to output the converted pixel data. At the same time, the NDAC2 126 also converts the second and fourth pixel data inputted time-divisionally into negative pixel signals, as shown in FIGS. 15A and 15B, to output the converted pixel data.

Then, in each of the $m^{th}$ and $(m+1)^{th}$ horizontal periods, the NDAC1 126 converts the third and first pixel data inputted time-divisionally into negative pixel signals to output the converted pixel data. At the same time, the PDAC2 124 converts the fourth and second pixel data inputted time-divisionally into positive pixel signals to output the converted pixel data. By such a DAC array 122, 2n pixel data are time-divided n by n for each ½ horizontal period to be converted into pixel signals and then outputted.

Each of (n+1) buffers 130 included in the buffer array 128 buffers and outputs a pixel signal from each of the PDAC's 124 and the NDAC's 126 of the DAC array 122.

The MUX2 array 140 determines a path of each pixel signal from the buffer array 128 in response to the polarity control signal POL from the timing controller. To this end, the MUX2 array 140 includes n (herein, for example, n=6) MUX2s 142. Each of the MUX2s 142 selects and outputs any one output of the two adjacent buffers 130 in response to the polarity control signal POL. Herein, the outputs of the remaining buffers 130 excluding the first and last buffers 130 are commonly inputted to the two adjacent MUX2s 142. The MUX2 array 142 having the above-described configuration allows the pixel signals from the buffers 130 excluding the last buffer 130 to be outputted as they are at a corresponding one-to-one relationship in response to the polarity control signal POL in the $(m-2)^{th}$ and $(m-1)^{th}$ horizontal periods.

Further, the MUX2 array 142 allows the pixel signals from the remaining buffers 130 excluding the first buffer 130 to be outputted to the DEMUXs 146 at a corresponding one-to-one relationship in response to the polarity control signal POL in the $m^{th}$ and $(m-1)^{th}$ horizontal periods. Similarly, the MUX2 array 140 determines the progress path of the pixel signals, the polarity of which is determined, in response to the polarity control signal POL, the polarity of which is inverted for each two horizontal periods, as shown in FIGS. 15A and 15B, for the vertical horizontal two-dot inversion driving. As a result, the pixel signals outputted from the MUX2 array 140 has the polarity inverted for each two horizontal periods having the polarity opposite to that of the adjacent pixel signals, thus they are suitable for the vertical horizontal two-dot inversion driving.

The DEMUX array 144 selectively applies the pixel signals from the MUX2 array 140 to 2n (herein, for example, n=6) data lines in response to the selection control signal θ1 from the timing controller. To this end, the DEMUX array 144 consists of n DEMUXs 146, each of which performs a time-division on the pixel signal from each MUX2 142 and applies to two data lines.

Specifically, each odd-numbered DEMUX 146 performs a time-division on the output of the odd-numbered MUX2 142 in response to the selection control signal θ1 to apply the time-divided output signals to two adjacent data lines. Each even-numbered DEMUX 146 performs a time-division on the output of the odd-numbered MUX2 142 in response to the selection control signal θ2 to apply the time-divided output signals to another two adjacent data lines. The selection control signal θ1, as shown in FIGS. 15A and 15B, has its polarity inverted for each horizontal period in the same way as being applied to the MUX1 array 114, in order to invert the output sequence of the pixel signals for each horizontal period and each frame.

For example, the first DEMUX 146 selectively applies an output of the first MUX2 142 to the first and second data lines D1 and D2 for each ½ horizontal period in response to the selection control signal θ1, as shown in FIGS. 15A and 15B, and alternately changes the sequence of selecting and outputting the pixel voltage for each horizontal period and each frame. Similarly, the second DEMUX 146 selectively applies the output of the second MUX2 142 to the third and fourth data lines D3 and D4 for each ½ horizontal period in response to the selection control signal θ1, as shown in FIGS. 15A and 15B, and alternately changes the sequence of selecting and outputting the pixel voltage for each horizontal period and each frame.

Differently, the charging amount difference of the pixel voltage can be compensated even when the charging sequence of the pixel signals is alternately changed for at least each two horizontal periods and each frame, as shown in FIGS. 16A and 16B.

In FIG. 16A corresponding to the odd-frame, at the first half of the first horizontal period H1, pixel data [1,1] and pixel data [1,3] are selected from a second latch array 110 in response to the first and second selection signals θ1 and θ2 and a horizontal synchronization signal 2HS demultiplied by two (hereinafter, demultiplied horizontal synchronization signal 2HS). Then, the selected data are converted into a positive pixel signal Vd[1,1] and a negative pixel signal Vd[1,3] in response to the polarity control signal POL. And, at the second half, pixel data [1,2] and pixel data [1,4] are selected in response to the first and second selection signals θ1 and θ2, the polarities of which are inverted, and the demultiplied horizontal synchronization signals 2HS, the polarity of which is retained. Then, the selected pixel data are converted into the positive pixel signal Vd[1,2] and the negative pixel signal Vd[1,4] in response to the polarity control signal POL, the polarity of which is retained. Accordingly, as shown in FIG. 8A, each of liquid crystal cells, [1,1] and [1,3] are charged with the positive pixel signal Vd[1,1] and the negative pixel signal Vd[1,3] at the first half of the first horizontal period, and each of liquid crystal cells [1,2] and [1,4] are charged with the positive pixel signal Vd[1,2] and the negative pixel signal Vd[1,4] at the second half.

Then, at the first half of the second horizontal period, pixel data [2,2] and pixel data [2,4] are selected in response to the demultiplied horizontal synchronization signal 2HS and the first and second selection signals θ1 and θ2, the polarities of which are retained. Then, the selected data are converted into a positive pixel signal Vd[2,2] and a negative pixel signal Vd[2,4] in response to the polarity control signal POL, the polarity of which is retained. And, at the second half, pixel data [2,1] and pixel data [2,3] are selected in response to the first and second selection signals θ1 and θ2, the polarities of which are inverted, and the demultiplied horizontal synchronization signal 2HS, the polarity of which is retained. Then the selected data are converted into the positive pixel signal Vd[2,1] and the negative pixel signal Vd[2,3] in response to the polarity control signal POL. Accordingly, as shown in FIG. 8A, each of liquid crystal cells [2,2] and [2,4] are charged with the positive pixel signal Vd[2,2] and the negative pixel signal Vd[2,4] at the first half of the second horizontal period, and each of the liquid crystal cells [2,1] and [2,3] are charged with the positive pixel signal Vd[2,1] and the negative pixel signal Vd[2,3] at the second half.

Subsequently, at the first half of the third horizontal period, pixel data [3,1] and pixel data [3,3] are selected in response to the first and second selection signals θ1 and θ2, the polarities of which are retained, and the demultiplied horizontal synchronization signal 2HS, the polarity of which is inverted. Then, the selected pixel data are converted into a negative pixel signal Vd[3,1] and a positive pixel signal Vd[3,3] in response to the polarity control signal POL, the polarity of which is inverted. And, at the second half, pixel data [3,2] and pixel data [3,4] are selected in response to the first and second selection signals θ1 and θ2, the polarities of which are inverted, and the demultiplied horizontal synchronization signal 2HS, the polarity of which is retained. Then, the selected pixel data are converted into the negative pixel signal Vd[3,2] and the positive pixel signal Vd[3,4] in response to the polarity control signal POL, the polarity of which is retained. Accordingly, as shown in FIG. 8A, each of liquid crystal cells [3,1] and [3,3] are charged with the negative pixel signal Vd[3,1] and the positive pixel signal Vd[3,3] at the first half of the third horizontal period, and each of liquid crystal cells [3,2] and [3,4] are charged with the negative pixel signal Vd[3,2] and the positive pixel signal Vd[3,4] at the second half.

And, at the first half of the fourth horizontal period, pixel data [4,2] and pixel data [4,4] are selected in response to the demultiplied horizontal synchronization signal 2HS and the first and second selection signals θ1 and θ2, the polarities of which are retained. Then, the selected pixel data are converted into a negative pixel signal Vd[4,2] and a positive pixel signal Vd[4,4] in response to the polarity control signal POL, the polarity of which is retained. And, at the second half, pixel data [4,1] and pixel data [4,3] are selected in response to the first and second selection signals θ1 and θ2, the polarities of which are inverted, and the demultiplied horizontal synchronization signal 2HS, the polarity of which is retained. Then, the selected pixel data are converted into the negative pixel signal Vd[4,1] and the positive pixel signal Vd[4,3] in response to the polarity control signal POL. Accordingly, as shown in FIG. 8A, each of liquid crystal cells [4,2] and [4,4] are charged with the negative pixel signal Vd[4,2] and the positive pixel signal Vd[4,4] at the first half of the fourth horizontal period, and each of liquid crystal cells [4,1] and [4,3] are charged with the negative pixel signal Vd[4,1] and the positive pixel signal Vd[4,3] at the second half.

In FIG. 16B corresponding to the even-frame, at the first half of the first horizontal period, the pixel data [1,2] and the pixel data [1,4] are selected in response to the demultiplied horizontal synchronization signal 2HS and the first and second selection signals θ1 and θ2, the polarities of which are inverted as compared with the odd-frame. Then, the selected pixel data are converted into the negative pixel signal Vd[1,2] and the positive pixel signal Vd[1,4] in response to the polarity control signal POL, the polarity of which is inverted as compared with the odd-frame. And, at the second half, the pixel data [1,1] and the pixel data [1,3] are selected in response to the first and second selection signals θ1 and θ2, the polarities of which are inverted, and the demultiplied horizontal synchronization signal 2HS, the polarity of which is retained. Then, the selected pixel data are converted into the negative pixel signal Vd[1,1] and the positive pixel signal Vd[1,3] in response to the polarity control signal POL, the polarity of which is retained. Accordingly, as shown in FIG. 8B, each of liquid crystal cells [1,2] and [1,4] are charged with the negative pixel signal Vd[1,2] and the positive pixel signal Vd[1,4] at the first half of the first horizontal period, and each of liquid crystal cells [1,1] and [1,3] are charged with the negative pixel signal Vd[1,1] and the positive pixel signal Vd[1,3] at the second half.

Then, at the first half of the second horizontal period, the pixel data [2,1] and the pixel data [2,3] are selected in response to the demultiplied horizontal synchronization signal 2HS and the first and second selection signals θ1 and θ2, the polarities of which are retained. Then, the selected pixel data are converted into the negative pixel signal Vd[2,1] and the positive pixel signal Vd[2,3] in response to the polarity control signal POL, the polarity of which is retained. And, at the second half, the pixel data [2,2] and the pixel data [2,4] are selected in response to the first and second selection signals θ1 and θ2, the polarities of which are inverted, and the demultiplied horizontal synchronization signal 2HS, the polarity of which is retained. Then, the selected pixel data are converted into the negative pixel signal Vd[2,2] and the positive pixel signal Vd[2,4] in response to the polarity control signal POL, the polarity of which is retained. Accordingly, as shown in FIG. 8B, each of liquid crystal cells [2,1] and [2,3] are charged with the negative pixel signal Vd[2,1] and the positive pixel signal Vd[2,3] at the first half of the second horizontal period, and each of liquid crystal cells [2,2] and [2,4] are charged with the negative pixel signal Vd[2,2] and the positive pixel signal Vd[2,4] at the second half.

Subsequently, at the first half of the third horizontal period, the pixel data [3,2] and the pixel data [3,4] are selected in response to the first and second selection signals θ1 and θ2, the polarities of which are retained, and the demultiplied horizontal synchronization signal 2HS, the polarity of which is inverted. Then, the selected pixel data are converted into the positive pixel signal Vd[3,2] and the negative pixel signal Vd[3,4] in response to the polarity control signal POL, the polarity of which is inverted. And, at the second half, the pixel data [3,1] and the pixel data [3,3] are selected in response to the first and second selection signals θ1 and θ2, the polarities of which are inverted, and the demultiplied horizontal synchronization signal, the polarity of which is retained. Then, the selected pixel data are converted into the positive pixel signal Vd[3,1] and the negative pixel signal Vd[3,3] in response to the polarity control signal POL, the polarity of which is retained. Accordingly, as shown in FIG. 8B, each of liquid crystal cells [3,2] and [3,4] are charged with the positive pixel signal Vd[3,2] and the negative pixel signal Vd[3,4] at the first half of the third horizontal period, and each of liquid crystal cells [3,1] and [3,3] are charged with the positive pixel signal Vd[3,1] and the negative pixel signal Vd[3,3] at the second half.

And, at the first half of the fourth horizontal period, the pixel data [4,1] and the pixel data [4,3] are selected in response to the demultiplied horizontal synchronization signal 2HS and the first and second selection signals θ1 and θ2, the polarities of which are retained. Then, the selected pixel data are converted into the positive pixel signal Vd[4,1] and the negative pixel signal Vd[4,3] in response to the polarity control signal POL, the polarity of which is retained. And, at the second half, the pixel data [4,2] and the pixel data [4,4] are selected in response to the first and second selection signals θ1 and θ2, the polarities of which are inverted, and the demultiplied horizontal synchronization signal 2HS, the polarity of which is retained. Then, the selected pixel data are converted into the positive pixel signal Vd[4,2] and the negative pixel signal Vd[4,4] in response to the polarity control signal POL. Accordingly, as shown in FIG. 8B, each of liquid crystal cells [4,1] and [4,3] are charged with the positive pixel signal Vd[4,1] and the negative pixel signal Vd[4,3] at the first half of the fourth horizontal period, and each of liquid crystal cells [4,2] and [4,4] are charged with the positive pixel signal Vd[4,2] and the negative pixel signal Vd[4,4] at the second half.

The data-driving IC having the above-described configuration drives by the vertical horizontal two-dot inversion scheme in which a pair of pixel data applied to a pair of data lines have the same polarity, and the pair of pixel signals have their polarities opposite to those of a pair of adjacent pixel signals applied to a pair of adjacent data lines. And, the pixel signals applied to each data line having a polarity inverted for each two horizontal period and each frame.

The data-driving IC according to the present invention drives the data lines on a time-division basis and drives 2n channels of data lines using (n+1) DAC, thus the number of data-driving IC's can be reduced to at least a half. Further, the data-driving IC alternately changes the supplying sequence (i.e., charging sequence) of the pixel signals for each horizontal period and each frame, thereby compensating the charging amount difference of the pixel voltage by a time-division driving of the data lines. In other words, when driving the data lines on a time-division basis, a difference in charging amount occurs due to the difference in charging time between the pixel voltages charged at the first half and the pixel voltages charged at the second half for each horizontal period. However, the difference in charging time can be compensated, as described above, when the charging sequence of the pixel voltage is alternately changed for at least each horizontal period and is alternately changed for each frame.

And, the data-driving IC according to the present invention of the present invention drives the liquid crystal display panel by the vertical horizontal two-dot inversion scheme, so as to prevent the cross-talks by the horizontal two-dot inversion scheme from occurring, as described above.

As described above, the data-driving apparatus and method for the liquid crystal display device according to the present invention drives the data lines on a time-division basis and drives 2n channels of data lines using (n+1) DAC, thus the number of data-driving IC's can be reduced to a half as compared to the related art, thereby reducing its manufacturing cost.

Further, in the apparatus and method for data-driving the liquid crystal display device according to the present invention, the charging sequence of the pixel voltage is alternately changed for each horizontal period and each frame, or for each two horizontal periods and each frame while it is driven time-divisionally. Accordingly, the charging amount difference of the pixel voltage caused by the difference in charging time in accordance with a time-divisional driving is compensated, thereby preventing the flicker phenomenon from occurring.

Furthermore, in the apparatus and method for data-driving the liquid crystal display device according to the present invention, the liquid crystal display panel is driven by the vertical horizontal two-dot inversion scheme, so that it prevents the cross-talks caused by the horizontal two-dot inversion scheme, as described above.

It will be apparent to those skilled in the art that various modifications and variations can be made in the apparatus and method for data-driving a liquid crystal display device of the present invention without departing from the spirit or scope of the inventions. Thus, it is intended that the present invention covers the modifications and variations of this invention provided they come within the scope of the appended claims and their equivalents.

What is claimed is:

1. A data-driving apparatus for a liquid crystal display device, comprising:

a first multiplexer array performing a time-division on inputted pixel data into odd-numbered and even-numbered pixel data, alternately changing a supplying sequence of the time-divided pixel data for at least one horizontal period and one frame, and supplying the time-divided pixel data;

a second multiplexer array alternately outputting the time-divided pixel data with an unshifted output channel and the time-divided pixel data with a shifted output channel to the right side by one channel for each of at least two horizontal periods in response to a polarity control signal having a polarity inverted for each of the at least two horizontal periods;

a digital-to-analog converter array converting the time-divided pixel data into analog pixel signals having a polarity opposite to the pixel data of adjacent channels;

a third multiplexer array alternately outputting the pixel signals with an unshifted output channel of the pixel signals and outputting the pixel signals shifted to the left side by one channel for the at least two horizontal periods in response to the polarity control signal; and a demultiplexer array performing a time-division on data lines into odd-numbered and even-numbered data lines and supplying the pixel signals to the time-divided data lines, and alternately changing a supplying sequence of the time-divided pixel signals for each horizontal period and each frame.

2. The data-driving apparatus according to claim 1, further comprising:

a shift register array sequentially generating sampling signals;

a latch array sequentially latching the inputted pixel data in response to the sampling signals and simultaneously outputting the latched pixel data to the first multiplexer array; and a buffer array buffering the pixel signals from the digital-to-analog converter array and supplying the buffered pixel signals to the third multiplexer array.

3. The data-driving apparatus according to claim 1, wherein the digital-to-analog converter array comprises total (n+1) number of positive and negative digital-to-analog converters when the demultiplexer array drives 2n data lines, and the positive digital-to-analog converters and the negative digital-to-analog converters are alternately arranged, wherein n is a positive integer.

4. The data-driving apparatus according to claim 1, wherein the first multiplexer array comprises at least n number of first multiplexers performing a time-division on 2n number of pixel data into the odd-numbered and even-numbered pixel data and supplying the time-divided pixel data, the second multiplexer array comprises at least (n−1) number of second multiplexers selecting one of outputs of two adjacent multiplexers of the first multiplexers, the third multiplexer array comprises at least n number of third multiplexers selecting one of outputs of two adjacent digital-to-analog converters of the digital-to-analog converters, the demultiplexer array comprises at least n number of demultiplexers dividing outputs of the third multiplexers and supplying the divided outputs to odd-numbered and even-numbered data lines, the outputs of the first multiplexers are commonly inputted to two adjacent multiplexers of the second multiplexers, and the outputs of the digital-to-analog converters are commonly inputted to two adjacent multiplexers of the third multiplexers, wherein n is a positive integer.

5. The data-driving apparatus according to claim 4, wherein the at least n number of the first multiplexers perform a time-division on the odd-numbered and even-numbered pixel data in response to first and second selection control signals and output the time-divided pixel data, and the at least n number of the demultiplexers perform a time-division on the odd-numbered and even-numbered data line in response to the first and second selection control signals and output the pixel signals from the third multiplexers, wherein n is a positive integer.

6. The data-driving apparatus according to claim 5, wherein the first and second selection control signals have polarities opposite to each other, and the polarities of the first and second selection control signals are inverted for each horizontal period or for each of two horizontal periods.

7. A data-driving apparatus for a liquid crystal display device, comprising:

a data register alternately outputting inputted pixel data with an unshifted output channel and the inputted pixel data with a shifted output channel by two channels for each of at least two horizontal periods;

a first multiplexer array performing a time-division on the pixel data from the data register into odd-numbered and even-numbered pixel data, alternately changing a supplying sequence of the time-divided pixel data for each horizontal period and each frame, and supplying the time-divided pixel data;

a digital-to-analog converter array converting the time-divided pixel data into analog pixel signals having a polarity opposite to the pixel data of adjacent channels;

a second multiplexer array alternately outputting the pixel signals with an unshifted output channel and the pixel signals with a shifted output channel to the left side by one channel for each of the at least two horizontal periods in response to a polarity control signal having a polarity inverted for each of the at least two horizontal periods; and a demultiplexer array performing a time-division on data lines into odd-numbered and even-numbered data lines, supplying the pixel signals to the odd-numbered and even-numbered data lines, and alternately changing a supplying sequence of the pixel signals for at least each horizontal period and each frame.

8. The data-driving apparatus according to claim 7, further comprising:

a shift register array sequentially generating sampling signals;

a latch array sequentially latching the inputted pixel data from the data register in response to the sampling signals and simultaneously outputting the latched pixel data to the first multiplexer array; and a buffer array buffering the pixel signals from the digital-to-analog converter array and supplying the buffered pixel signals to the second multiplexer array.

9. The data-driving apparatus according to claim 7, wherein the digital-to-analog converter array includes total (n+1) number of positive and negative digital-to-analog converters when the demultiplexer array drives 2n data lines, and the positive digital-to-analog converters and the negative digital-to-analog converters are alternately arranged, wherein n is a positive integer.

10. The data-driving apparatus according to claim 7, wherein the first multiplexer array comprises at least n number of first multiplexers performing a time-division on 2n number of pixel data into the odd-numbered and even-numbered pixel data in response to a selection control signal and supplying the time-divided pixel data, the second multiplexer array comprises at least n number of second multiplexers selecting one of outputs of two adjacent digital-to-analog converters of the digital-to-analog converters in response to a polarity control signal, the demultiplexer array comprises at least n number of demultiplexers dividing outputs of the second multiplexers in response to the selection control signal and supplying the divided outputs to the odd-numbered and even-numbered data lines, and the outputs of each of the digital-to-analog converters are commonly inputted to at least two of the second multiplexers, wherein n is a positive integer.

11. The data-driving apparatus according to claim 10, wherein the selection control signal has a polarity inverted for each horizontal period or for each of two horizontal periods.

12. A data-driving method for a liquid crystal display device, comprising:

performing a time-division on inputted pixel data into odd-numbered and even-numbered pixel data in response to a selection control signal;

alternately outputting the time-divided pixel data with an unshifted output channel and the time-divided pixel data with a shifted output channel to the right side by one channel for each of at least two horizontal periods in response to a polarity control signal having a polarity inverted for each of the at least two horizontal periods;

converting the time-divided pixel data into analog pixel signals having a polarity opposite to the pixel data of adjacent channels;

alternately outputting the pixel signals with an unshifted output channel and the pixel signals with a shifted output channel to the left side by one channel for each of the at least two horizontal periods;

performing a time-division on data lines into odd-numbered and even-numbered data lines in response to the selection control signal and supplying the pixel signals to the time-divided data lines; and alternately changing a supplying sequence of the time-divided pixel data and a supplying sequence of the pixel signals to the time-divided data lines for at least each horizontal period and each frame.

13. A data-driving method for a liquid crystal display device, comprising:

alternately outputting inputted pixel data with an unshifted output channel and the inputted pixel data with a shifted output channel by two channels for each of at least two horizontal periods;

performing a time-division on the pixel data into odd-numbered and even-numbered pixel data in response to a selection control signal, and supplying the time-divided pixel data;

converting the time-divided pixel data into analog pixel signals having a polarity opposite to the pixel data of adjacent channels;

alternately outputting the pixel signals with an unshifted output channel and the pixel signals with a shifted output channel to the left side by one channel for each of the at least two horizontal periods in response to a polarity control signal having a polarity inverted for each of the at least two horizontal periods;

performing a time-division on data lines into odd-numbered and even-numbered data lines in response to the selection control signal and supplying the pixel signals to the time-divided data lines; and alternately changing a supplying sequence of the time-divided pixel data and a supplying sequence of the pixel signals to the time-divided data lines for at least each horizontal period and each frame.

14. The data-driving method according to claim 12, further comprising, sequentially generating sampling signals prior to the performing a time-division on the pixel data and supplying the time-divided pixel data, sequentially latching the pixel data in response to the sample signals, and simultaneously supplying the latched pixel data, and buffering the pixel signals after converting into the pixel signals.

15. The data-driving method according to claim 12, wherein the selection control signal has a polarity inverted for each horizontal period or each of two horizontal periods.

16. A data-driving method for a liquid crystal display device, comprising:

performing a time-division on inputted pixel data into odd-numbered and even-numbered pixel data in response to a selection control signal;

alternately outputting the time-divided pixel data with an unshifted output channel and the time-divided pixel data with a shifted output channel to the right side by one channel for each of at least two horizontal periods in response to a polarity control signal having a polarity inverted for each of the at least two horizontal periods;

alternately outputting the pixel data with an unshifted output channel and the pixel data with a shifted output channel to the left side by one channel for each of the at least two horizontal periods;

performing a time-division on data lines into odd-numbered and even-numbered data lines in response to the selection control signal and supplying the pixel data to the time-divided data lines; and alternately changing a supplying sequence of the time-divided pixel data and a supplying sequence of the pixel data to the time-divided data lines for at least each horizontal period and each frame.

* * * * *